US006305789B1

(12) United States Patent
Nakata et al.

(10) Patent No.: US 6,305,789 B1
(45) Date of Patent: Oct. 23, 2001

(54) LIQUID EJECTING HEAD, LIQUID EJECTING DEVICE AND LIQUID EJECTING METHOD

(75) Inventors: Yoshie Nakata, Kawasaki; Hiroshi Sugitani, Machida; Masami Ikeda, Yokohama; Makiko Kimura, Sagamihara; Toshio Kashino, Chigasaki; Takeshi Okazaki, Sagamihara; Aya Yoshihira; Kiyomitsu Kudo, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/586,095

(22) Filed: Jan. 16, 1996

(30) Foreign Application Priority Data

| | | |
|---|---|---|
| Jan. 13, 1995 | (JP) | 7-004109 |
| Apr. 26, 1995 | (JP) | 7-127317 |
| Sep. 1, 1995 | (JP) | 7-225221 |
| Nov. 22, 1995 | (JP) | 7-304622 |

(51) Int. Cl.[7] ..... B41J 2/05
(52) U.S. Cl. ..... 347/61
(58) Field of Search ..... 347/61, 56, 54, 347/20, 1, 65

(56) References Cited

U.S. PATENT DOCUMENTS

| | | | |
|---|---|---|---|
| 4,412,224 | 10/1983 | Sugitani . | |
| 4,417,251 | 11/1983 | Sugitani . | |
| 4,437,100 | 3/1984 | Sugitani et al. . | |
| 4,450,455 | 5/1984 | Sugitani et al. . | |
| 4,480,259 | 10/1984 | Kruger et al. . | |
| 4,496,960 | 1/1985 | Fischbeck | 346/140 R |
| 4,509,063 | 4/1985 | Sugitani et al. . | |
| 4,521,787 | 6/1985 | Yokota et al. . | |
| 4,558,333 | 12/1985 | Sugitani et al. . | |
| 4,568,953 | 2/1986 | Aoki et al. . | |
| 4,609,427 | 9/1986 | Inamoto et al. . | |
| 4,611,219 | 9/1986 | Sugitani et al. . | |
| 4,646,110 | 2/1987 | Ikeda et al. . | |
| 4,666,823 | 5/1987 | Yokota et al. . | |

(List continued on next page.)

FOREIGN PATENT DOCUMENTS

| | | | | |
|---|---|---|---|---|
| 0160463 | | 11/1985 | (EP) . | |
| 0 443 798 A2 | * | 2/1991 | (EP) | 347/61 |
| 0 436 047 | | 7/1991 | (EP) . | |
| 443798A2 | | 8/1991 | (EP) . | |
| 55-81172 | | 6/1980 | (JP) . | |
| 61-69467 | | 4/1986 | (JP) . | |
| 61-110557 | | 5/1986 | (JP) . | |
| 62-156969 | | 7/1987 | (JP) . | |
| 63-28654 | | 2/1988 | (JP) . | |
| 63-197652 | | 8/1988 | (JP) . | |
| 63-199972 | | 8/1988 | (JP) . | |
| 3-81155 | | 4/1991 | (JP) . | |
| 4-118248 | | 4/1992 | (JP) . | |
| 5-124189 | | 5/1993 | (JP) . | |
| 5-229122 | | 9/1993 | (JP) . | |
| 6-87214 | | 3/1994 | (JP) . | |

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

A liquid ejecting method for ejecting liquid by generation of a bubble includes preparing a head comprising an ejection outlet for ejecting the liquid, a bubble generation region for generating the bubble in the liquid, a movable member disposed faced to the bubble generation region and displaceable between a first position and a second position further from the bubble generation region than the first position; and displacing the movable member from the first position to the second position by pressure produced by the generation of the bubble in the bubble generating portion to permit expansion of the bubble more in a downstream side nearer to the ejection outlet than in an upstream side.

68 Claims, 23 Drawing Sheets

U.S. PATENT DOCUMENTS

| | | | | |
|---|---|---|---|---|
| 4,723,129 | | 2/1988 | Endo et al. . | |
| 4,994,825 | | 2/1991 | Saito et al. . | |
| 5,095,321 | | 3/1992 | Saito et al. . | |
| 5,208,604 | | 5/1993 | Watanabe et al. . | |
| 5,262,802 | | 11/1993 | Karita et al. . | |
| 5,278,585 | * | 1/1994 | Karz et al. | 347/65 |
| 5,389,957 | | 2/1995 | Kimura et al. . | |
| 5,485,184 | | 1/1996 | Nakagomi et al. . | |

* cited by examiner

LIQUID EJECTING HEAD, LIQUID EJECTING DEVICE AND LIQUID EJECTING METHOD

FIELD OF THE INVENTION AND RELATED ART

The present invention relates to a liquid ejecting head for ejecting desired liquid using generation of a bubble by applying thermal energy to the liquid, a head cartridge using the liquid ejecting head, a liquid ejecting device using the same, a manufacturing method for the liquid ejecting head, a liquid ejecting method, a recording method, and a print provided using the liquid ejecting method. It further relates to an ink jet head kit containing the liquid ejection head.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 propose flow passage structures as disclosed in FIG. 1, (*a*) and (*b*), for example.

The liquid path or passage structure of a manufacturing method therefor are proposed from the standpoint of the back wave toward the liquid chamber. This back wave is considered as energy loss since it does not contribute to the liquid ejection. It proposes a valve 10 disposed upstream of the heat generating element 2 with respect to the direction of general flow of the liquid, and is mounted on the ceiling of the passage. It takes an initial position wherein it extends along the ceiling. Upon bubble generation, it takes the position wherein it extends downwardly, thus suppressing a part of the back wave by the valve 10. When th valve is generated in the path 3, the suppression of the back wave is not practically significant. The back wave is not directly contributable to the ejection of the liquid. Upon the back wave occurs in the path, the pressure for directly ejecting the liquid already makes the liquid ejectable from the passage.

On the other hand, in the bubble jet recording method, the heating is repeated with the heat generating element contacted with the ink, and therefore, a burnt material is deposited on the surface of the heat generating element due to kogation of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Accordingly, it is a principal object of the present invention to provide a liquid ejection principle with which the generated bubble is controlled in a novel manner.

It is another object of the present invention to provide a liquid ejecting method, liquid ejecting head and so on wherein heat accumulation in the liquid on the heat generating element is significantly reduced, and the residual bubble on the heat generating element is reduced, while improving the ejection efficiency and the ejection pressure.

It is a further object of the present invention to provide a liquid ejecting head and so on wherein inertia force in a direction against liquid supply direction due to back wave is suppressed, and simultaneously, a degree of retraction of a meniscus is reduction by a valve function of a movable member by which the refilling frequency is increased, thus permitting high speed printing.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejecting method, a liquid ejecting head and so on, wherein the choice of the liquid to be ejected is made greater.

It is a further object of the present invention to provide a manufacturing method for a liquid ejecting head with which such a liquid ejecting head is easily manufactured.

It is a further object of the present invention to provide a liquid ejecting head, a printing apparatus and so on which can be easily manufactured because a liquid introduction path for supplying a plurality of liquids are constituted with a small number of parts. It is an additional object to provide a downsized liquid ejecting head and device.

It is a further object of the present invention to provide a good print of an image using an above-described ejection method.

It is a further object of the present invention to provide a head kit for permitting easy refuse of the liquid ejecting head.

According to an aspect of the present invention, there is provided a liquid ejecting method for ejecting liquid by generation of a bubble, comprising: preparing a head comprising an ejection outlet for ejecting the liquid, a bubble generation region for generating the bubble in the liquid, a movable member disposed faced to said bubble generation region and displaceable between a first position and a second position further from said bubble generation region than the first position; and displacing said movable member from said first position to said second position by pressure produced by the generation of the bubble in said bubble generating portion to permit expansion of the bubble more in a downstream side nearer to the ejection outlet than in an upstream side.

According to another aspect of the present invention there is provided a liquid ejecting method for ejecting liquid by generation of a bubble, comprising: supplying the liquid along a heat generating element disposed along a flow path from upstream of the heat generating element; and applying heat generated by the heat generating element to the thus supplied liquid to generate a bubble, thus moving a free end of a movable member having the free end adjacent the ejection outlet side by pressure produced by the generation of the bubble, said movable member being disposed faced to said heat generating element.

According to a further aspect of the present invention there is provided a liquid ejecting method for ejecting liquid by generation of a bubble, comprising: preparing a head including a first liquid flow path in fluid communication with a liquid ejection outlet, a second liquid flow path having a bubble generation region and a movable member disposed between said first liquid flow path and said bubble generation region and having a free end adjacent the ejection outlet side; and generating a bubble in said bubble generation region to displace the free end of the movable member into said first liquid flow path by pressure produced by the generation of the bubble, thus guiding the pressure toward the ejection outlet of said first liquid flow path by the movement of the movable member to eject the liquid.

According to a further aspect of the present invention there is provided a liquid ejecting head for ejecting liquid by generation of bubble, comprising: projection outlet for ejecting the liquid; a bubble generation region for generating the bubble in the liquid; a movable member disposed faced to said bubble generation region and displaceable between a first position and a second position further from said bubble generation region than the first position; wherein said movable member moves from said first position to said second position by pressure produced by the generation of the bubble to permit expansion of the bubble more in a downstream side nearer to the ejection outlet than in an upstream side.

According to a further aspect of the present invention there is provided a liquid ejecting head for ejecting liquid by generation of bubble, comprising: an ejection outlet for ejecting the liquid; a heat generating element for generating the bubble in the liquid by applying heat to said liquid; a liquid flow path having a supply passage for supplying the liquid to said heat generating element from upstream thereof; and a movable member disposed faced to said heat generating element and having a free end adjacent said ejection outlet, the free end of said movable member being moved by pressure produced by the generation of the bubble to guide the pressure toward said ejection outlet.

According to a further aspect of the present invention there is provided a liquid ejecting head for ejecting liquid by generation of bubble, comprising: an ejection outlet for ejecting the liquid; a heat generating element for generating the bubble in the liquid by applying heat to said liquid; a liquid flow path having a supply passage for supplying the liquid to said heat generating element from upstream thereof; a movable member disposed faced to said heat generating element and having a free end adjacent said ejection outlet, the free end of said movable member being moved by pressure produced by the generation of the bubble to guide the pressure toward said ejection outlet; and a liquid passage for supplying the liquid to said heat generating element from upstream along such a side of said movable member as is nearer to said heat generating element.

According to a further aspect of the present invention there is provided a liquid ejecting head for ejecting liquid by generation of bubble, comprising: a first liquid flow path in fluid communication with an ejection outlet; a second liquid flow path having bubble generation region for generating the bubble in the liquid by applying heat to the liquid; a movable member disposed between said first liquid flow path and said bubble generation region and having a free end adjacent the ejection outlet, wherein the free end of the movable member is displaced into said first liquid flow path by pressure produced by the generation of the bubble, thus guiding the pressure toward the ejection outlet of said first liquid flow path by the movement of the movable member to eject the liquid.

According to a further aspect of the present invention there is provided a liquid ejecting head for ejecting liquid by generation of bubble, comprising: a grooved member integrally having a plurality of ejection outlets for ejecting the liquid, a plurality of grooves for forming a plurality of first liquid flow paths in direct fluid communication with said ejection outlets, and a recess for forming a first common liquid chamber for supplying the liquid to said first liquid flow paths; an element substrate having a plurality of heat generating elements for generating the bubble in the liquid by applying heat to the liquid; and a partition wall disposed between said grooved member and said element substrate and forming a part of walls of second liquid flow paths corresponding to said heat generating elements, and a movable member movable into said first liquid flow paths by pressure produced by the generation of the bubble, said movable member being faced to said heat generating element.

According to a further aspect of the present invention there is provided a head cartridge comprising: a liquid ejecting head as defined above; and a liquid container for containing the liquid to be supplied to the liquid ejecting head.

According to a further aspect of the present invention there is provided a liquid ejecting apparatus for ejecting recording liquid by generation of a bubble, comprising: a liquid ejecting head as defined above; and driving signal supply means for supplying a driving signal for ejecting the liquid through the liquid ejecting head.

According to a further aspect of the present invention there is provided a liquid ejecting apparatus for ejecting recording liquid by generation of a bubble, comprising: a liquid ejecting head as defined above; and recording material transporting means for feeding a recording material for receiving the liquid ejected from the liquid ejecting head.

According to a further aspect of the present invention there is provided a recording system comprising: a liquid ejecting apparatus as defined above; and a pre-processing or post-processing means for promoting fixing of the liquid on the recording material after the recording.

According to a further aspect of the present invention there is provided a head kit comprising: a liquid ejecting head as defined above; and a liquid container containing the liquid to be supplied to the liquid ejecting head.

According to a further aspect of the present invention there is provided a head kit comprising: a liquid ejecting head as defined above; a liquid container for containing the liquid to be supplied to the liquid ejecting head; and liquid filling means for filling the liquid into the liquid container.

According to a further aspect of the present invention there is provided a recorded material characterized by being recorded by ejected ink through a liquid ejection recording method as defined above.

According to a further aspect of the present invention there is provided a high speed liquid filling method for a liquid ejecting head comprising: a liquid ejecting head for ejecting liquid by generation of bubble including an ejection outlet for ejecting the liquid; a heat generating element for generating the bubble in the liquid by applying heat to said liquid; a liquid flow path having a supply passage for supplying the liquid to said heat generating element from upstream thereof; a movable member disposed faced to said heat generating element and having a free end adjacent said ejection outlet, the free end of said movable member being moved by pressure produced by the generation of the bubble to guide the pressure toward said ejection outlet; and supplying the liquid to said heat generating member along said heat generating element from upstream thereof.

According to a further aspect of the present invention there is provided a method for removing residual bubble in a liquid ejecting head comprising: preparing a liquid ejecting head including an ejection outlet for ejecting the liquid; a heat generating element for generating the bubble in the liquid by applying heat to said liquid; a liquid flow path having a supply passage for supplying the liquid to said heat generating element from upstream thereof; a movable member disposed faced to said heat generating element and having a free end adjacent said election outlet, the free end of said movable member being moved by pressure produced by the generation of the bubble to guide the pressure toward said ejection outlet; and supplying the liquid to said heat generating member along said heat generating element from upstream thereof to remove the residual bubble on said heat generating means.

According to a further aspect of the present invention there is provided a manufacturing method for a liquid ejecting head wherein: the liquid ejecting head including a first recess for forming a first liquid flow path in fluid communication with an ejection outlet, a partition wall having a movable member movable to the first recess, a second recess for forming a second liquid flow path for containing the liquid for moving the movable member, and an ejection energy generating means disposed corresponding to the second recess, is manufactured by forming a wall for forming the second recess on an element substrate, and then mounting a member having the partition wall and the first recess to the element substrate having the second recess.

According to a further aspect of the present invention there is provided a manufacturing method for a liquid ejecting head wherein: the liquid ejecting head including a first recess for forming a first liquid flow path in fluid communication with an ejection outlet, a first member integrally having a partition wall having a movable member movable to the first recess, a second recess for forming a second liquid flow path for containing liquid for moving the movable member of the partition wall, and an ejection energy generating means disposed corresponding to the second recess, is manufactured by: forming a wall for forming the second recess on an element substrate provided with the ejection energy generating means; and then mounting the first member having the first recess.

According to a further aspect of the present invention there is provided a liquid droplet ejecting method for ejecting a liquid droplet through an ejection outlet by a bubble generated by film boiling, comprising: providing a movable member having a movable surface and a free end; and moving the free end by a part of a bubble providing at least a pressure component directly contributable to the liquid droplet ejection to guide said part toward the ejection outlet.

According to a further aspect of the present invention there is provided a liquid droplet ejecting method for ejecting a liquid droplet through an ejection outlet disposed at a position not faced to a bubble generation region and downstream of the bubble generation region with respect to a liquid droplet ejection direction, by generation of bubble in the bubble generation region, wherein Providing a movable member having a free end portion for substantially sealing an ejection outlet side region of said bubble generation region relative to said ejection outlet and a surface portion extending from the free end portion to a fulcrum portion which is disposed away from the free end in a direction away from from said ejection outlet; Moving said free end from it substantial sealing position by generation of the bubble to open said bubble generation region to the ejection outlet to eject the liquid droplet.

With the liquid ejecting method and the head using the novel ejection principle, a synergistic effect is provided by the generated bubble and the movable member moved thereby so that the liquid adjacent the ejection outlet can be ejection with high efficiency, and therefore, the ejection efficiency is improved. For example, in the most desirable type of the present invention, the ejection efficiency is increased even to twice the conventional one.

In another aspect of the present invention, even if the printing operation is started after the recording head is left in a low temperature or low humidity condition for a long term, the ejection failure can be avoided. Even if the ejection failure occurs, the normal operation is recovered by a small scale recovery process including a preliminary ejection and sucking recovery.

In an aspect of improving the refilling property, the responsivity, the stabilized growth of the bubble and stabilization of the liquid droplet during the continuous ejections are accomplished, thus permitting high speed recording.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Embodiment 1

Referring to the accompanying drawings, the embodiments of the present invention will be described.

Figure 1A:
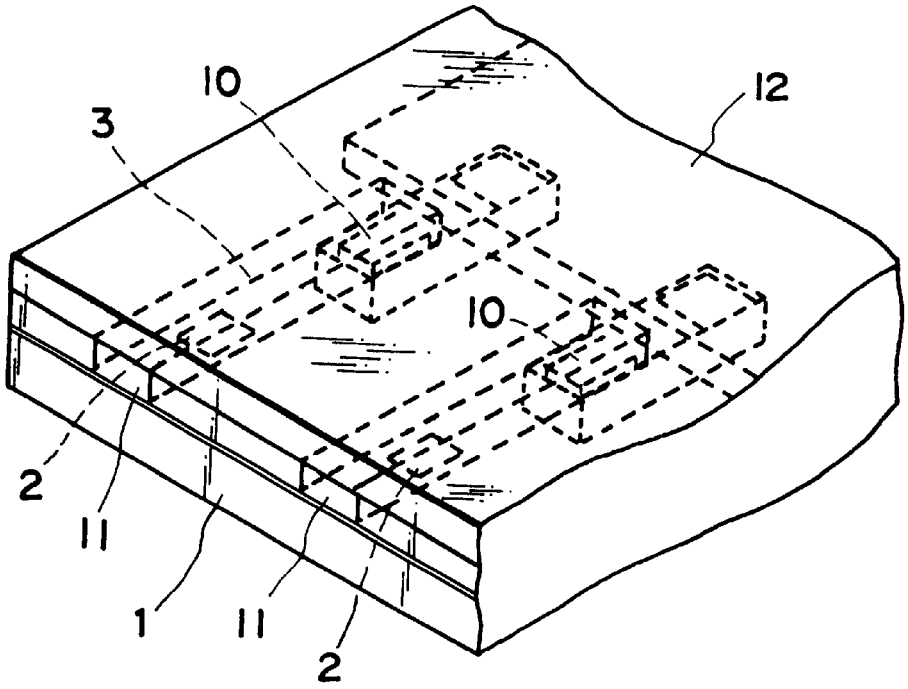
FIG. 1(a) PRIOR ART
FIGS. 1(*a*) and 1(*b*) are sectional view of a liquid flow path of a conventional liquid ejecting head.
Figure 1B:
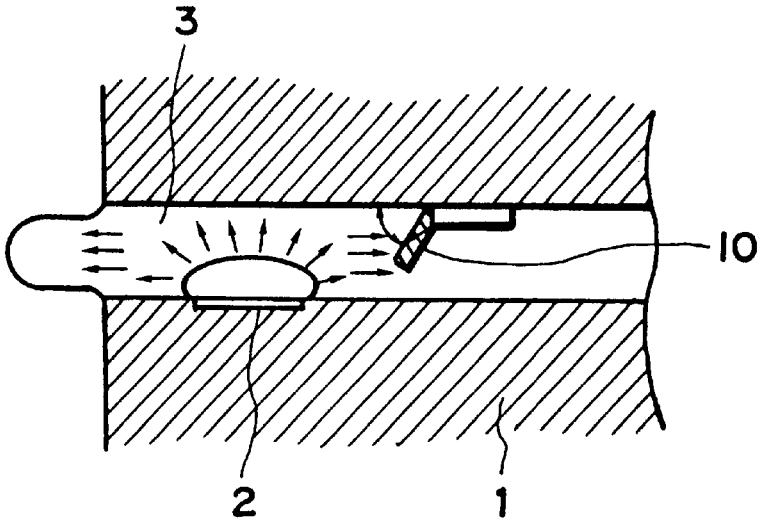
FIG. 1(b) PRIOR ART
Figure 2A:
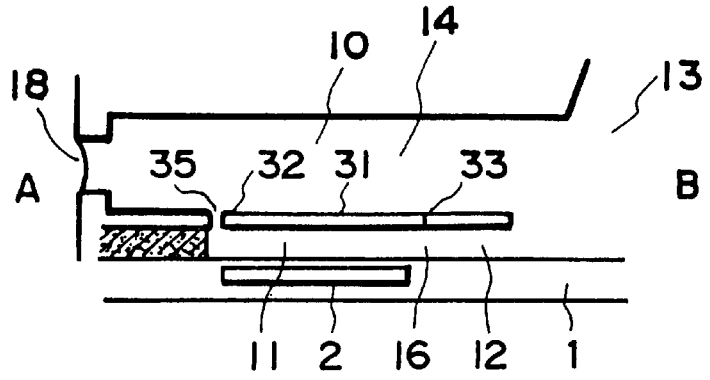
FIGS. 2(*a–d*) are schematic sectional views of an example of a liquid ejecting head of an embodiment of the present inventions
Figure 2B:
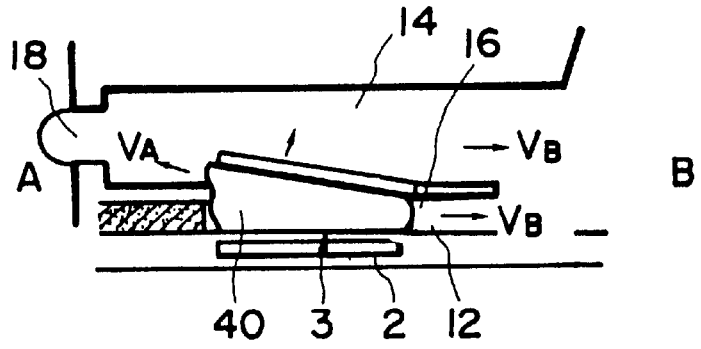
Figure 2C:
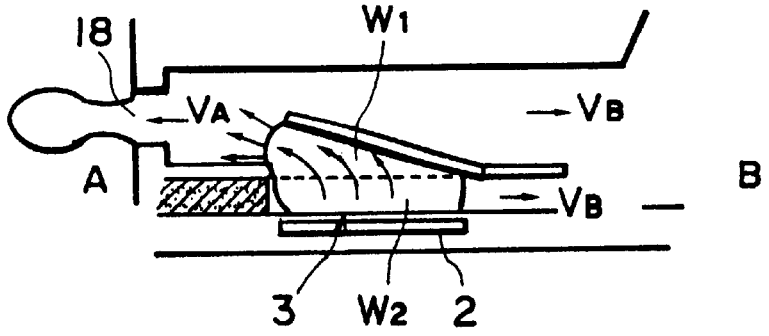
Figure 2D:
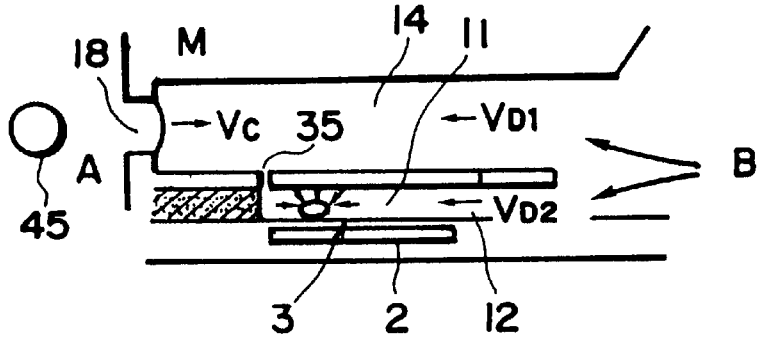
Figure 3:
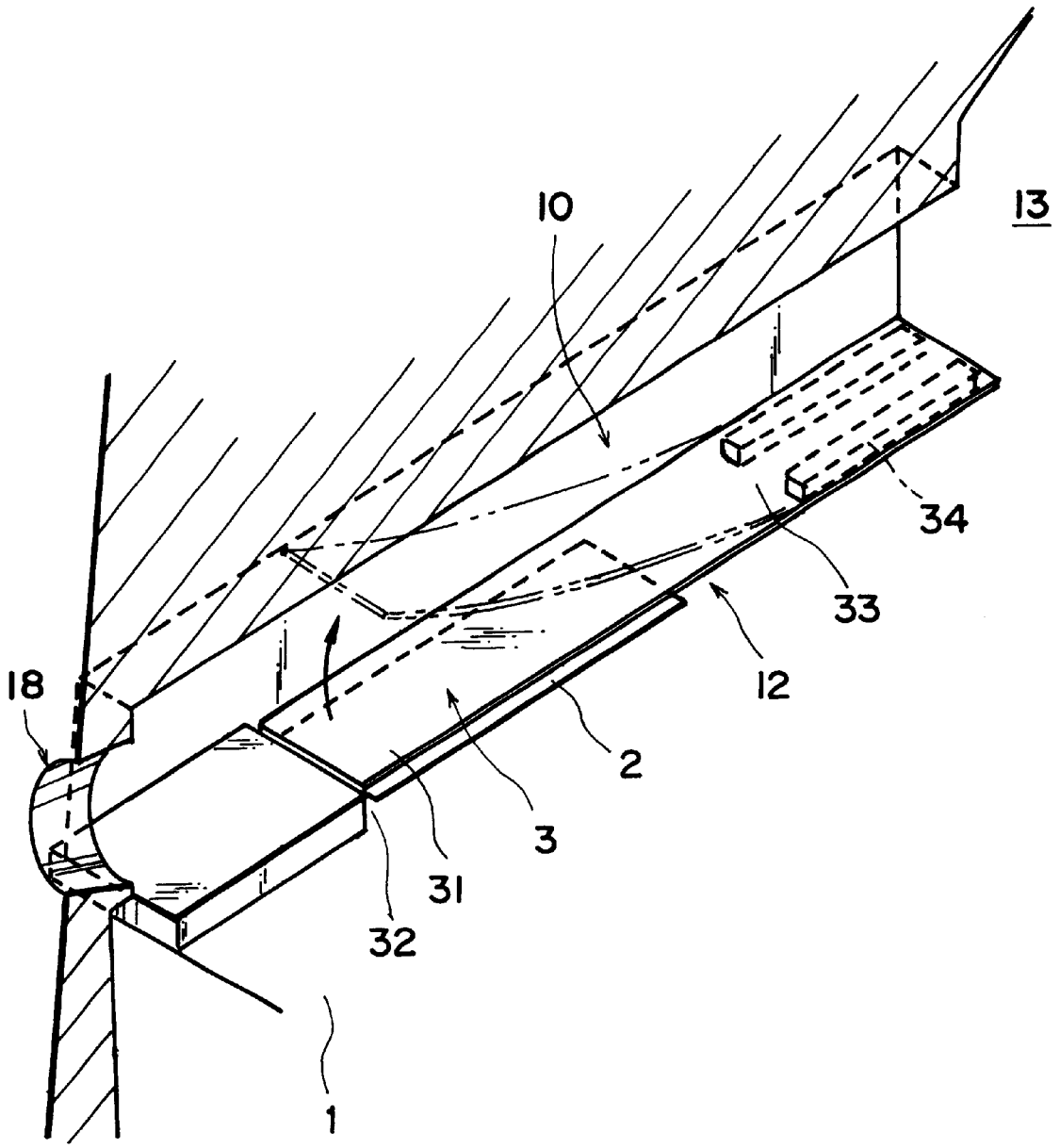
FIG. 3 is a partly broken perspective view of a liquid ejecting head according to an embodiment of the present invention.

In this embodiment, the description will be made as to an improvement in an ejection force and/or an ejection efficiency by controlling a direction of propagation of pressure resulting from generation of a bubble for ejecting the liquid and controlling a direction of growth of the bubble. FIG. 2 is a schematic sectional view of a liquid ejecting head taken along a liquid flow path according to this embodiment, and FIG. 3 is a partly broken perspective view of the liquid ejecting head.

The liquid ejecting head of this embodiment comprises a heat generating element 2 (a heat generating resistor of 40 μm×105 μm in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. The movable member 31 is faced to the heat generating element 2 with a gap of 15 μm approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIGS. 2, (*b*) and (*c*) or in FIG. 3. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 4:
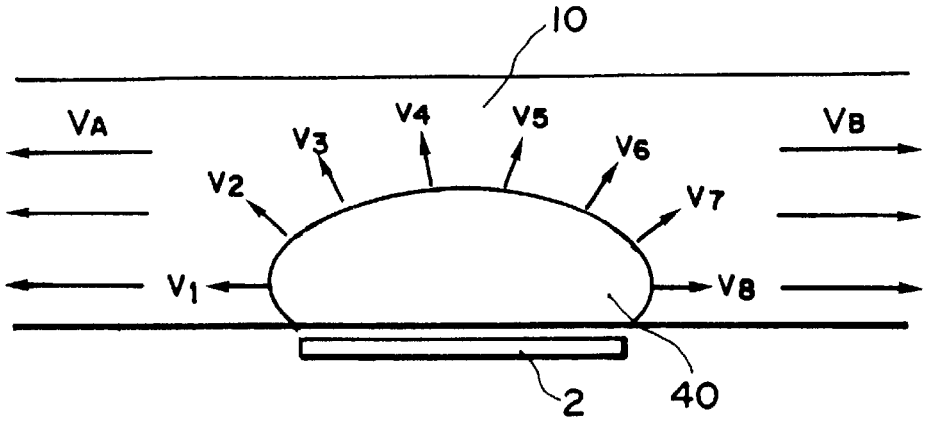
FIG. 4 PRIOR ART
FIG. 4 is a schematic view of pressure propagation from a bubble in a conventional head.
Figure 5:
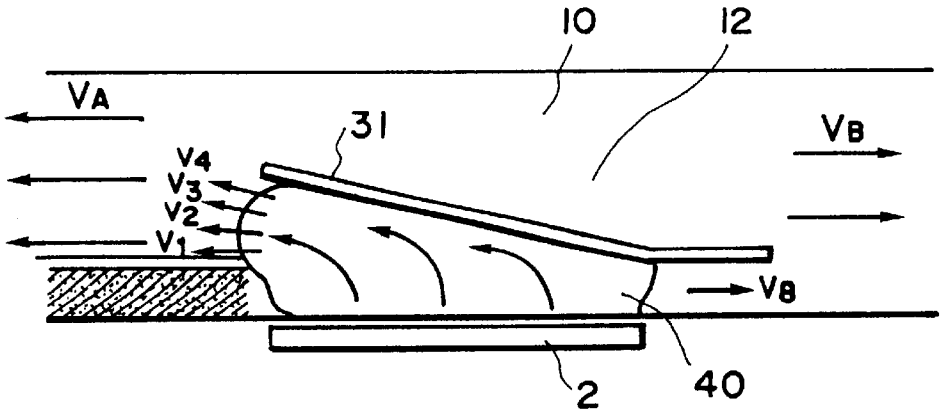
FIG. 5 is a schematic view of pressure propagation from a bubble in a head according to an embodiment of the present invention.

More detailed description will be made with comparison between the conventional liquid flow passage structure not using the movable member (FIG. 4) and the present invention (FIG. 5). Here, the direction of propagation of the pressure toward the ejection outlet is indicated by $V_A$, and the direction of propagation of the pressure toward the upstream is indicated by $V_B$.

In a conventional head as shown in FIG. 4, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. This portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 2, the ejecting operation of the liquid ejecting head in this embodiment will be described in detail.

FIG. 2, (*a*) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 2, (*b*) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 2, (*c*) shows a state in which the bubble 40 has further grown, by the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 2, (*d*) shows a state wherein the bubble 40 contracts and disappears by the decrease of the pressure in the bubble, peculiar to the film boiling phenomenon.

The movable member 31 having been displaced to the second position returns to the initial position (first position) of FIG. 2, (*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_c$ so as to compensate for the volume reduction of the bubble in the bubble generation region 11 and to compensate for the volume of the ejected liquid.

In the foregoing, the description has been made as to the operation of the movable member with the generation of the bubble and the ejecting operation of the liquid. Now, the description will be made as to the refilling of the liquid in the liquid ejecting head of the present invention.

Referring to FIG. 2, liquid supply mechanism will be described.

When the bubble 40 enters the bubble collapsing process after the maximum volume thereof after FIG. 2, (*c*) state, a volume of the liquid enough to compensate for the collapsing bubbling volume flows into the bubble generation region from the ejection outlet 18 side of the first liquid flow path 14 and from the bubble generation region of the second liquid flow path 16.

In the case of conventional liquid flow passage structure not having the movable member 31, the amount of the liquid from the ejection outlet side to the bubble collapse position and the amount of the liquid from the common liquid chamber thereinto, are attributable to the flow resistances of the portion closer to the ejection outlet than the bubble generation region and the portion closer to the common liquid chamber.

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 6:
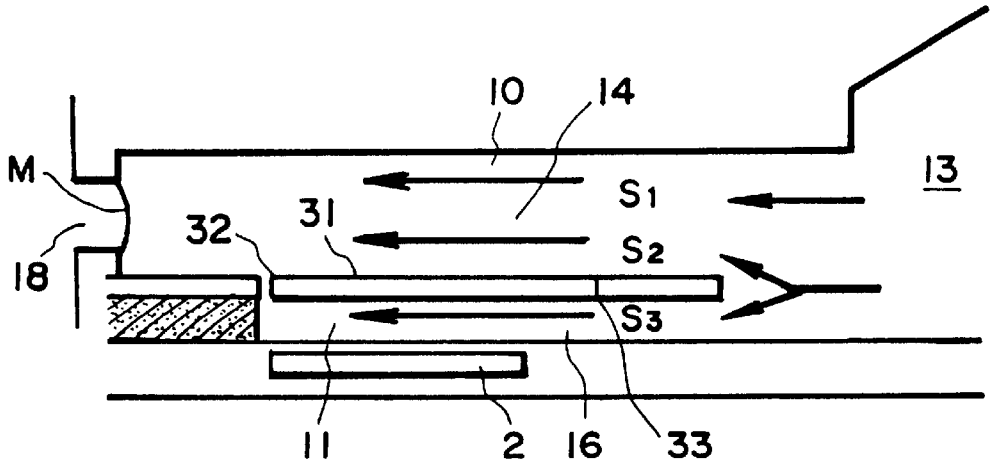
FIG. 6 is a schematic view of a liquid flow in an embodiment of the present invention.

The positional relation between the free end 32 and the fulcrum 33 of the movable member 31 is such that the free end is at a downstream position of the fulcrum as indicated by 6 in the Figure, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 6, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

Embodiment 2

Figure 7:
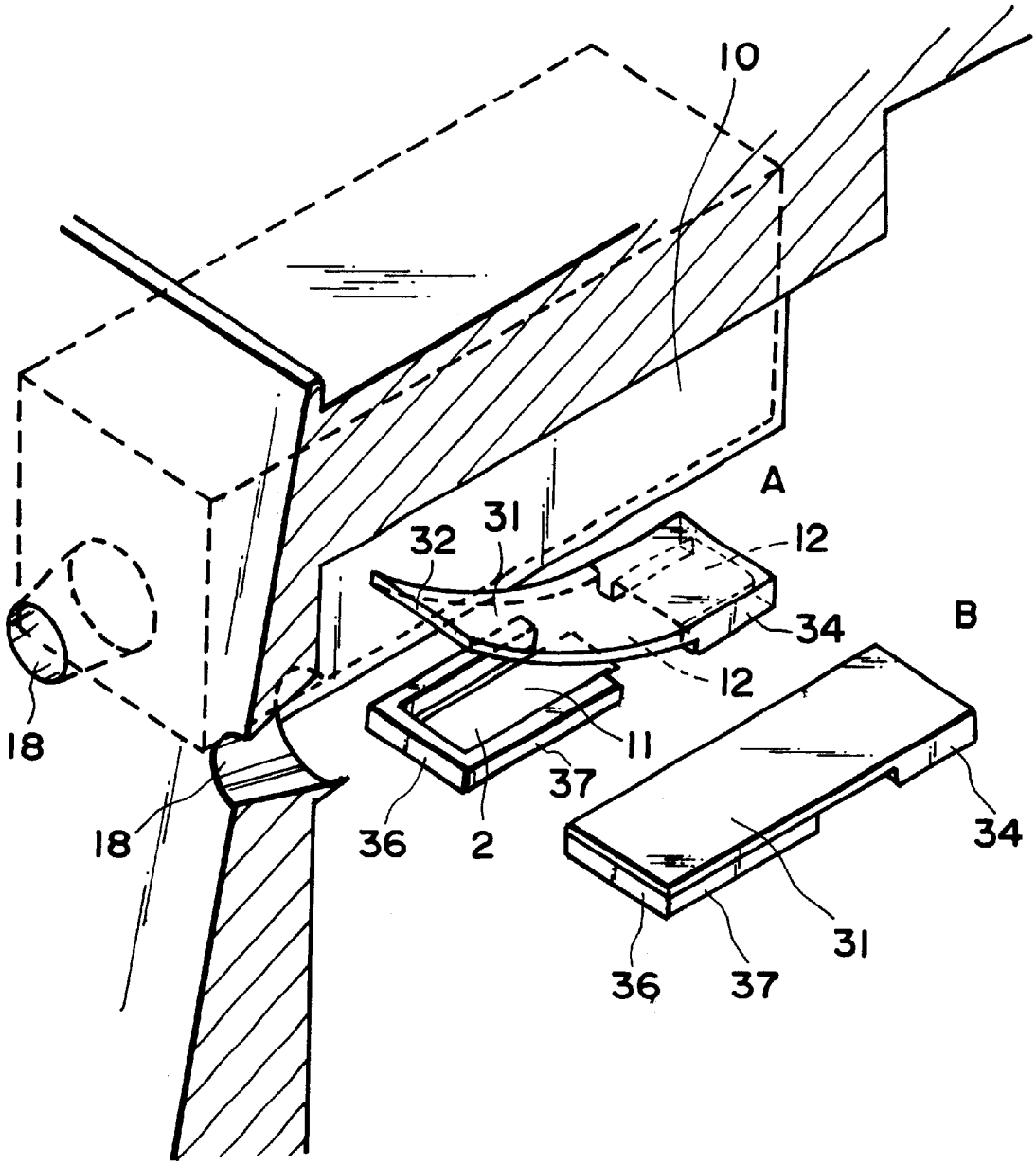
FIG. 7 is a partly partly broken perspective view of a liquid ejecting head according to a second embodiment of the present invention.

FIG. 7 shows a second embodiment. In FIG. 7, A shows a displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

A foundation 34 is provided at each side, and between them, a liquid supply passage 12 is constituted. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that the ejection outlet 18 side of the bubble generation region 11 is substantially sealed. Thus, the pressure produced by the bubble at the time of the bubble generation and particularly the pressure downstream of the bubble, can be concentrated on the free end side side of the movable member, without releasing the pressure.

In the process of the collapse of bubble, the movable member 31 returns to the first position, and the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

In this embodiment, the foundation 34 for supporting and fixing the movable member 31 is provided at an upstream position away from the heat generating element 2, as shown in FIG. 3 and FIG. 7, and the foundation 34 has a width smaller than the liquid flow path 10 to supply the liquid to the liquid supply passage 12. The configuration of the foundation 34 is not limited to this structure, but may be anyone if smooth refilling is accomplished.

In this embodiment, the clearance between the movable member 31 and the clearance is 15 $\mu$m approx., but the distance may be changed as long as the pressure produced by the bubble generation is sufficiently propagated to the movable member.

Embodiment 3

Figure 8:
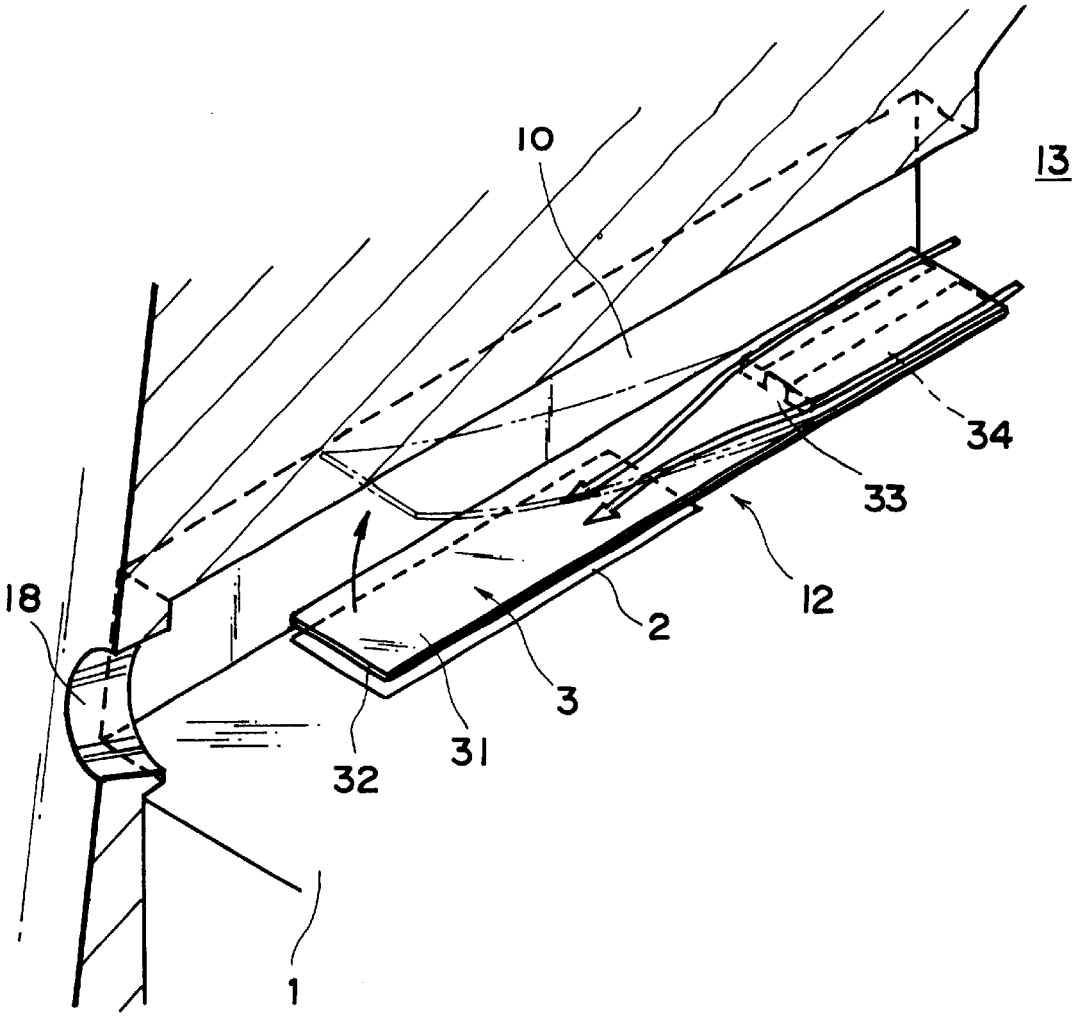
FIG. 8 is a partly broken perspective view of a liquid ejecting head according to a third embodiment of the present invention.

FIG. 8 shows one of the fundamental aspects of the present invention. FIG. 8 shows a positional relation among a bubble generation region, bubble and the movable member in one liquid flow path to further describe the liquid ejecting method and the refilling method according to an aspect of the present invention.

In the above described embodiment, the pressure by the generated bubble is concentrated on the free end of the movable member to accomplish the quick movement of the movable member and the concentration of the movement of the bubble to the ejection outlet side. In this embodiment, the bubble is relatively free, while a downstream portion of the bubble which is at the ejection outlet side directly contributable to the droplet ejection, is regulated by the free end side of the movable member.

More particularly, the projection (hatched portion) functioning as a barrier provided on the heat generating element substrate 1 of FIG. 3 is not provided in this embodiment. The free end region and opposite lateral end regions of the movable member do not substantially seal the bubble generation region relative to the ejection outlet region, but it opens the bubble generation region to the ejection outlet region, in this embodiment.

In this embodiment, the growth of the bubble is permitted at the downstream leading end portion of the downstream portions having direct function for the liquid droplet ejection, and therefore, the pressure component is effectively used for the ejection. Additionally, the upward pressure in this downstream portion (component forces $V_{B2}$, $V_{B3}$ and $V_{B4}$) acts such that the free end side portion of the movable member is added to the growth of the bubble at the leading end portion. Therefore, the ejection efficiency is improved similarly to the foregoing embodiments. As compared with the embodiment, this embodiment is better in the responsivity to the driving of the heat generating element.

The structure of this embodiment is simple, and therefore, the manufacturing is easy.

The fulcrum portion of the movable member 31 of this embodiment is fixed on one foundation 34 having a width smaller than that of the surface of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the third embodiment, both of the lateral sides (or only one lateral side) are substantially sealed for the bubble generation region 11. With such a structure, the pressure toward the lateral side of the movable member is also directed to the ejection outlet side end portion, so that the ejection efficiency is further improved.

Embodiment 4

Figure 9:
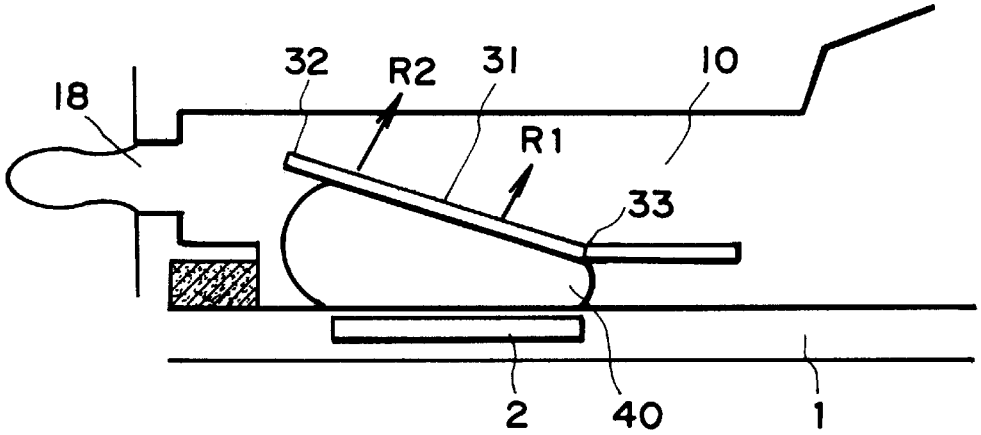
FIG. 9 is a partly broken perspective view of a liquid ejecting head according to a fourth of the present invention.

In the following embodiment, the ejection force for the liquid by the mechanical displacement is further improved. FIG. 9 is a cross-sectional view of this embodiment. In FIG. 9, the movable member is extended such that the position of the free end of the movable member 31 is positioned further downstream of the heat generating element. By this, the displacing speed of the movable member at the free end position is further increased, so that the generation of the ejection pressure by the displacement of the movable member is further improved.

In addition, the free end is closer to the ejection outlet side than in the foregoing embodiment, and therefore, the growth of the bubble can be concentrated toward the stabilized direction, thus assuring the better election.

In response to the growth speed of the bubble at the central portion of the pressure of the bubble, the movable member 31 displaces at a displacing speed R1. The free end 32 which is at a position further than this position from the fulcrum 33, displaces at a higher speed R2. Thus, the free end 32 mechanically acts on the liquid at a higher speed to increase the ejection efficiency.

The free end configuration is such that, as is the same as in FIG. 8, the edge is vertical to the liquid flow, by which the pressure of the bubble and the mechanical function of the movable member are more efficiently contributable to the ejection.

Embodiment 5

Figure 10A:
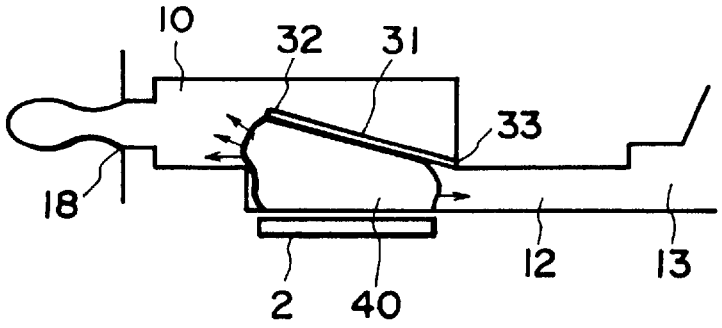
FIGS. 10(*a–c*) are partly broken perspective views of a liquid ejecting head according to a fifth embodiment of the present invention.
Figure 10B:
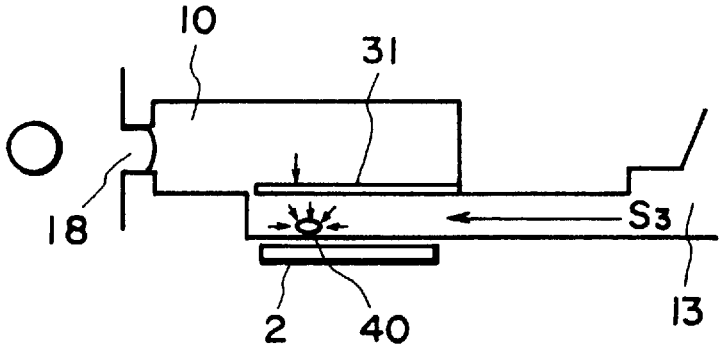
Figure 10C:
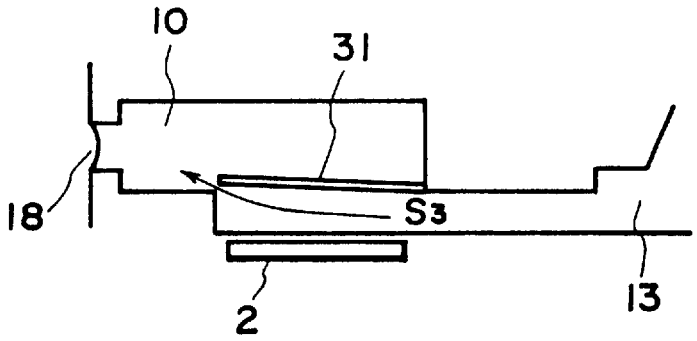

FIGS. 10, (*a*), (*b*) and (*c*) illustrate a fifth embodiment of the present invention.

As is different from the foregoing embodiment, the region in direct communication with the ejection outlet is not in communication with the liquid chamber side, by which the structure is simplified.

The liquid is supplied only from the liquid supply passage 12 along the surface of the bubble generation region side of the movable member 31. The free end 32 of the movable member 31, the positional relation of the fulcrum 33 relative to the ejection outlet 18 and the structure of facing to the heat generating element 2 are similar to the above-described embodiment.

According to this embodiment, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble.

FIG. 10, (*a*) shows a state in which the bubble generation is caused by the heat generating element 2, and FIG. 10, (*b*) shows the state in which the bubble is going to contract. At this time, the returning of the movable member 31 to the initial position and the liquid supply by $S_3$ are effected.

In FIG. 10, (*c*), the small retraction M of the meniscus upon the returning to the initial position of the movable member, is being compensated for by the refilling by the capillary force in the neighborhood of the ejection outlet 18.

Embodiment 6

The description will be made as to another embodiment.

The ejection principle for the liquid in this embodiment is the same as in the foregoing embodiment. The liquid flow path has a multi-passage structure, and the liquid (bubble generation liquid) for bubble generation by the heat, and the liquid (ejection liquid) mainly ejected, are separated.

Figure 11:
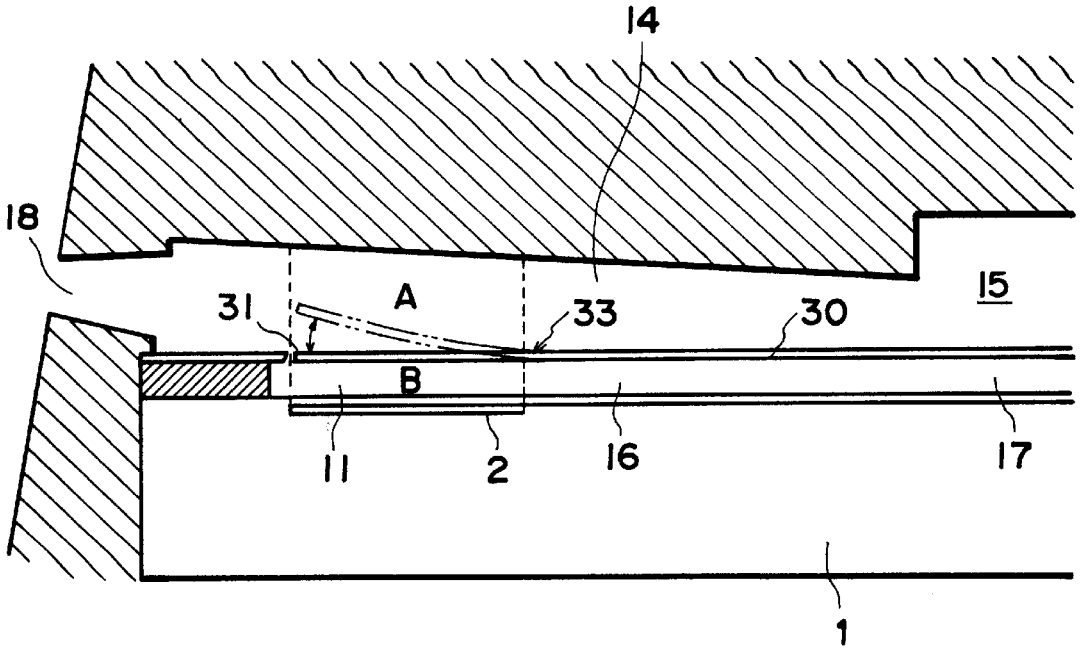
FIG. 11 is a sectional view of a liquid ejecting head (2 flow path) according to a sixth embodiment of the present invention.

FIG. 11 is a sectional schematic view in a direction along the flow path of the liquid ejecting head of this embodiment.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

Figure 12:
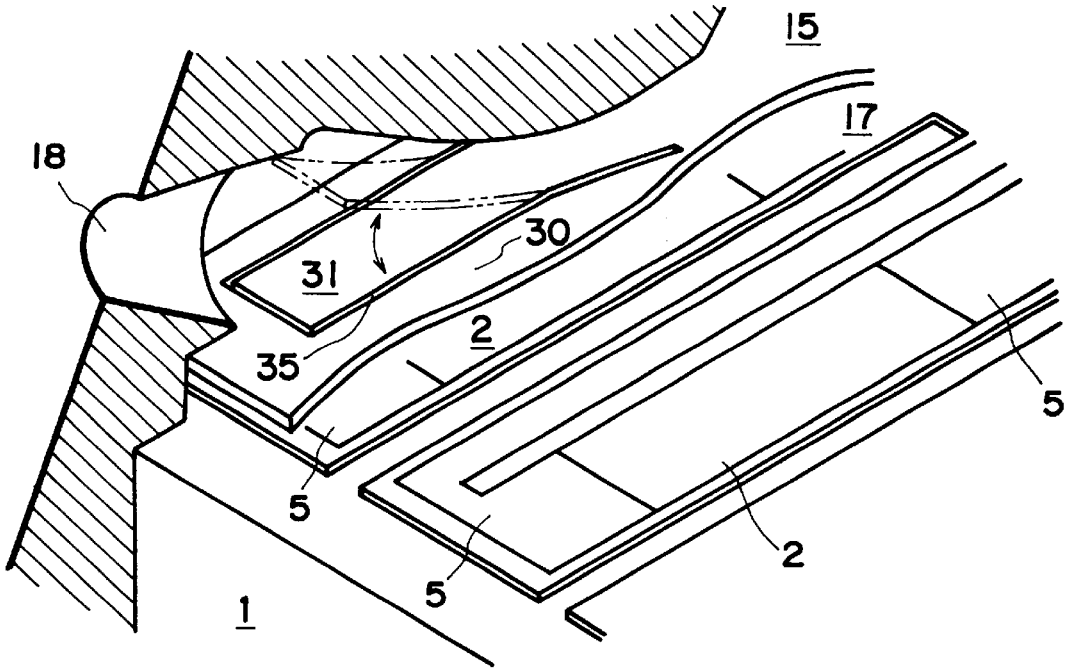
FIG. 12 is a partly broken perspective view of a liquid ejecting head according to j a sixth embodiment of the present invention.

A portion of the partition wall in the upward projection space of the heat generating element (ejection pressure generation region including A and B (bubble generation region 11) in FIG. 11), is in the form of a cantilever movable member 31, formed by slits 35, having a fulcrum 33 at the common liquid chamber (15 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). In an example of FIG. 12, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 13A:
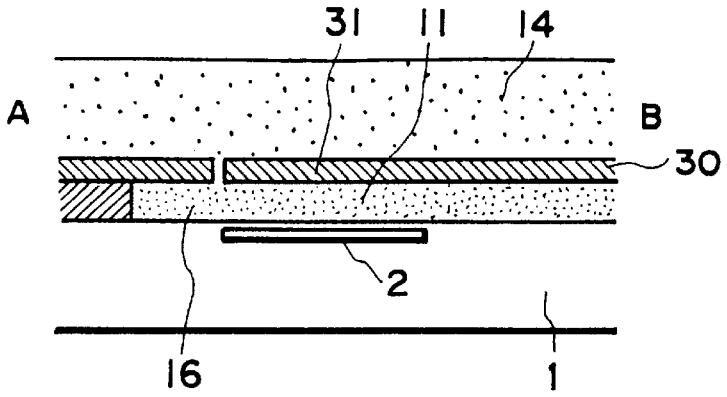
FIGS. 13(*a*) and 13(*b*) are illustrations of an operation of a movable member.
Figure 13B:
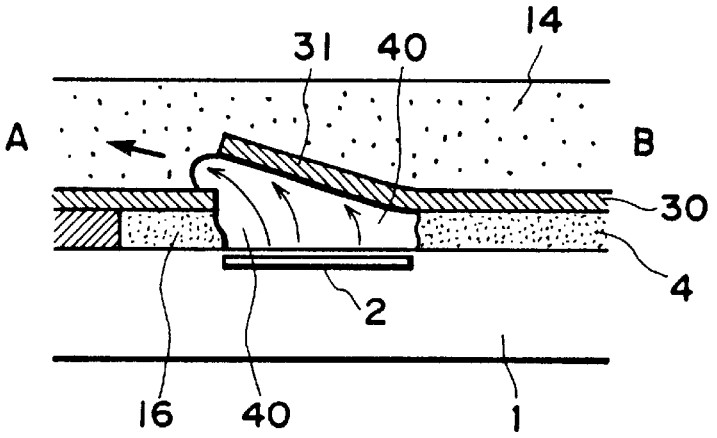

Referring to FIG. 13, the operation of the liquid ejecting head of this embodiment will be described.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that the pressure produced by the bubble generation is propagated concentratedly on the movable member 6 side in the ejection pressure generation portion, by which the movable member 6 is displaced from the position indicated in FIG. 13, (*a*) toward the first liquid flow path side as indicated in FIG. 13, (*b*) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 13, (*a*), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of the anol and water (4:6). By doing so, the ejection liquid can be properly ejected.

Additionally, by selecting as the bubble generation liquid a liquid with which the deposition such as kogation does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

Other Embodiments

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

Liquid Flow Path Ceiling Configuration

Figure 14:
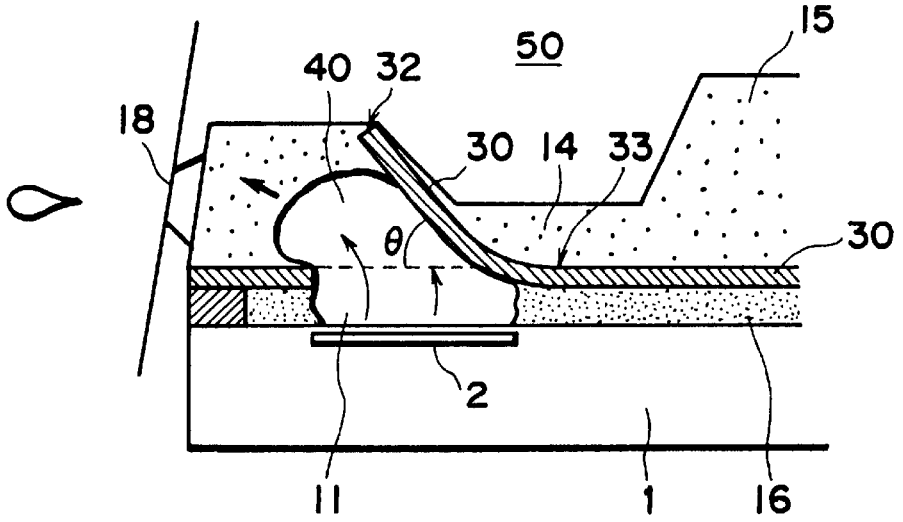
FIG. 14 is an illustration of a structure of a second liquid flow path and a movable member.

FIG. 14 is a sectional view taken along the length of the flow path of the liquid ejecting head according to the embodiment. Grooves for constituting the first liquid flow paths 14 (or liquid flow paths 10 in FIG. 2) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can be further effectively prevented.

Positional Relation Between Second Liquid Flow Path and Movable Member

Figure 15A:
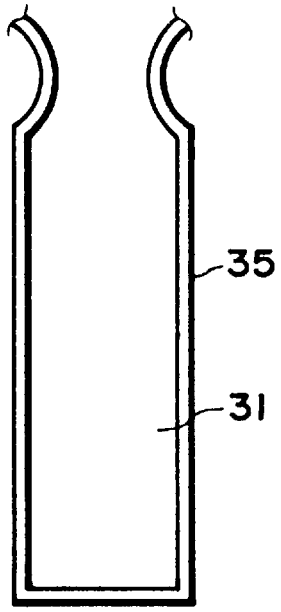
FIGS. 15(*a–c*) are illustrations of a structure of a liquid flow path and a movable member.
Figure 15B:
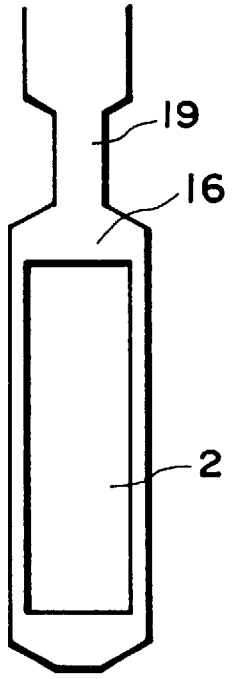
Figure 15C:
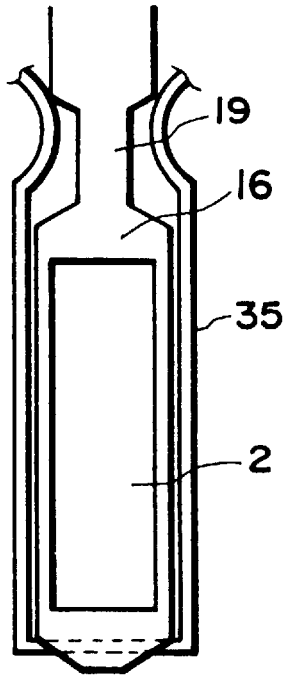

FIG. 15 is an illustration of a positional relation between the above-described movable member 31 and second liquid flow path 16, and (*a*) is a view of the movable member 31 position of the partition wall 30 as seen from the above, and (*b*) is a view of the second liquid flow path 16 seen from the above without partition wall 30. FIG. 15, (*c*) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that the filling amount of the bubble generation liquid to the bubble generation region 11 may be small. Therefore, the clearance at the throat portion 19 can be made very small, for example, as small as several $\mu$m–ten and several $\mu$m, so that the release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the second liquid flow path 16 is not limited to the one described above, but may be any if the pressure produced by the bubble generation is effectively transmitted to the movable member side.

As shown in FIG. 15, (*c*), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 13, (*b*) and FIG. 14, a part of of the bubble generated in the bubble generation region of the second liquid flow path 4 with the displacement of the movable member 6 to the first liquid flow path 14 side, extends into the first liquid flow path 14 side. By selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the second liquid flow path is preferably several $\mu$m–30 $\mu$m, for example. In this embodiment, the height is 15 $\mu$m.

Movable Member and Partition Wall

Figure 16A:
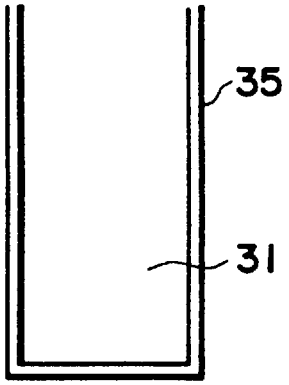
FIGS. 16(*a–c*) are illustrations of another configuration of the movable member.
Figure 16B:
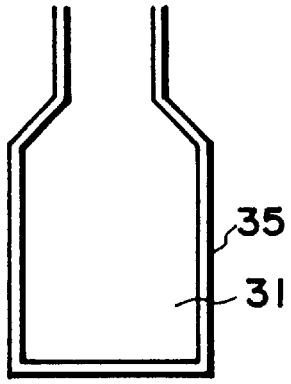
Figure 16C:
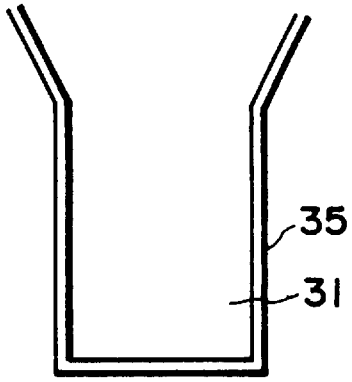

FIG. 16 shows another example of the movable member 31, wherein reference numeral 35 designates a slit formed in the partition wall, and the slit is effective to provide the movable member 31. In FIG. 16, (*a*), the movable member has a rectangular configuration, and in (*b*), it is narrower in the fulcrum side to permit increased mobility of the movable member, and in (*c*), it has a wider fulcrum side to enhance the durability of the movable member. The configuration narrowed and arcuated at the fulcrum side is desirable as shown in FIG. 15, (*a*), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 $\mu$m, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, poly-sulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used, material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

When the ejection liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%. The percentage of the mixing can be controlled in the present invention by properly selecting the viscosities of the ejection liquid and the bubble generation liquid.

When the percentage is desired to be small, it can be reduced to 5%, for example, by using 5 CPS or lower for the bubble generation liquid and 20 CPS or lower for the ejection liquid.

In this invention, the movable member has a thickness of μm order as preferable thickness, and a movable member having a thickness of cm order is not used in usual cases. When a slit is formed in the movable member having a thickness of μm order, and the slit has the width (W μm) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 13, 14 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

In a conventional bubble jet recording method, energy such as heat is applied to the ink to generate instantaneous volume change (generation of bubble) in the ink, so that the ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of kogation on the heat generating element, that is, the non-bubble-generation area S extends in the marginal area of the heat generating element. It is understood that the marginal approx. 4 μm width is not contributable to the bubble generation.

In order to effectively use the bubble generation pressure, it is preferable that the movable range of the movable member covers the effective bubble generating region of the heat generating element, namely, the inside area beyond the marginal approx. 4 μm width. In this embodiment, the effective bubble generating region is approx. 4μ and inside thereof, but this is different if the heat generating element and forming method is different.

Figure 18A:
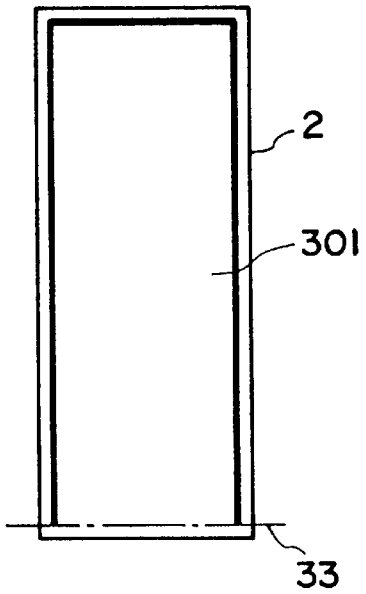
FIGS. 18(*a*) and 18(*b*) are illustrations of a positional relation between a movable member and a heat generating element.
Figure 18B:
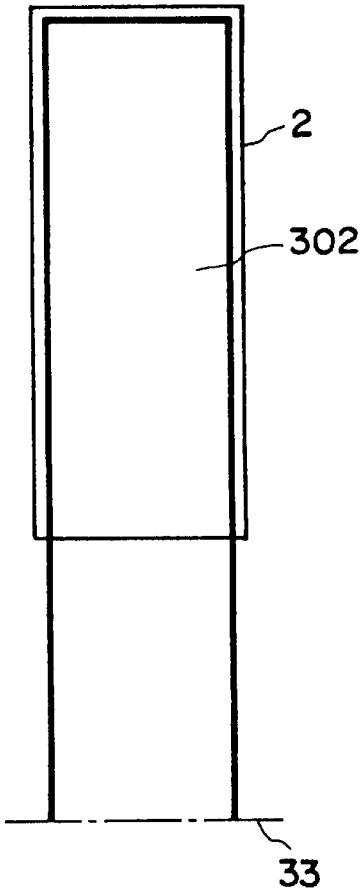

FIG. 18 is a schematic view as seen from the top, wherein the use is made with a heat generating element 2 of 58×150 μm, and with a movable member 301, FIG. 18, (*a*) and a movable member 302, FIG. 18, (*b*) which have different total area.

The dimension of the movable member 301 is 53×145 μm, and is smaller than the area of the heat generating element 2, but it has an area equivalent to the effective bubble generating region of the heat generating element 2, and the movable member 301 is disposed to cover the effective bubble generating region. On the other hand, the dimension of the movable member 302 is 53×220 μm, and is larger than the area of the heat generating element 2 (the width dimension is the same, but the dimension between the fulcrum and movable leading edge is longer than the length of the heat generating element), similarly to the movable member 301. It is disposed to cover the effective bubble generating region. The tests have been carried out with the two movable members 301 and 302 to check the durability and the ejection efficiency. The conditions were as follows:

Bubble generation liquid: Aqueous solution of ethanol (40%)

Ejection ink: dye ink

Voltage: 20.2 V

Frequency: 3 kHz

The results of the experiments show that the movable member 301 was damaged at the fulcrum when $1\times10^7$ pulses were applied. The movable member 302 was not damaged even after $3\times10^8$ pulses were applied. Additionally, the ejection amount relative to the supplied energy and the kinetic energy determined by the ejection speed, are improved by approx. 1.5–2.5 times.

From the results, it is understood that a movable member having an area larger than that of the heat generating element and disposed to cover the portion right above the effective bubble generating region of the heat generating element, is preferable from the standpoint of durability and ejection efficiency.

Figure 19:
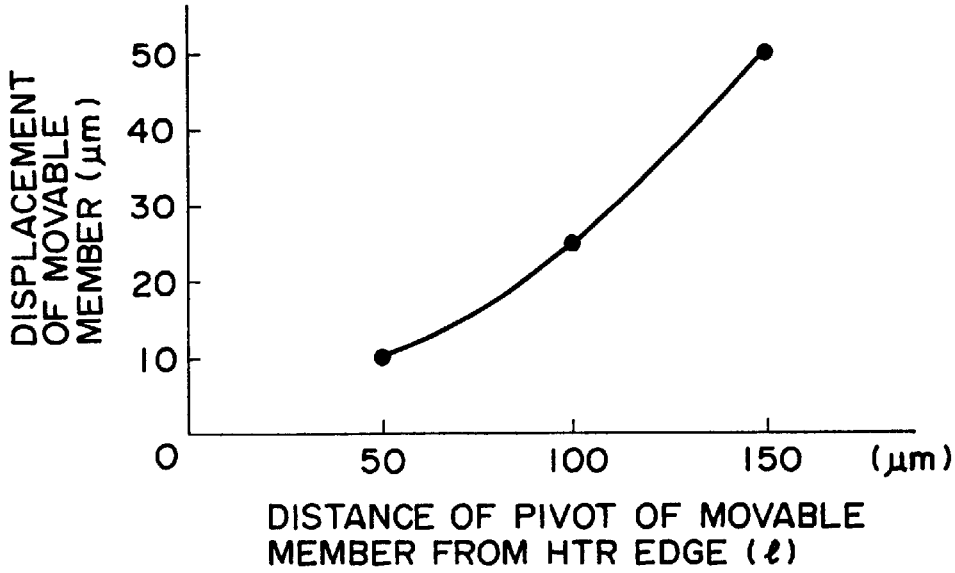
FIG. 19 is an illustration of a relation between a distance between an edge of the heat generating element and the fulcrum and a movement distance of the movable member.
Figure 20:
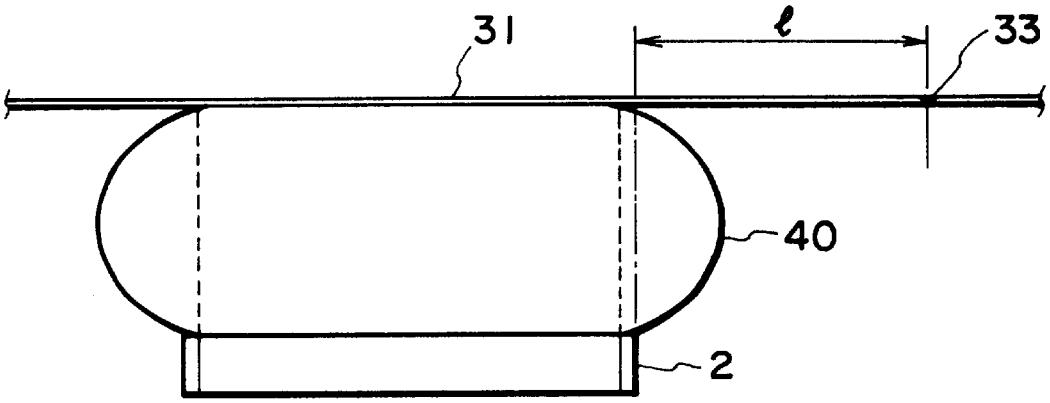
FIG. 20 shows a positional relation between the heat generating element and the movable member.

FIG. 19 shows a relation between a distance between the edge of the heat generating element and the fulcrum of the movable member and the displacement of the movable member. FIG. 20 is a section view, as seen from the side, which shows a positional relation between the heat generating element 2 and the movable member 31. The heat generating element 2 has a dimension of 40×105 μm. It will be understood that the displacement increases with increase with the distance of 1 from the edge of the heat generating element 2 and the fulcrum 33 of the movable member 31. Therefore, it is desirable to determinate the position of the fulcrum of the movable member on the basis of the optimum displacement depending on the required ejection amount of the ink, flow passage structure, heat generating element configuration and so on.

When the fulcrum of the movable member is right above the effective bubble generating region of the heat generating element, the bubble generation pressure is directly applied to the fulcrum in addition to the stress due to the displacement of the movable member, and therefore, the durability of the movable member lowers. The experiments by the inventors have revealed that when the fulcrum is provided right above the effective bubble generating region, the movable wall is damaged after application of $\times 10^6$ pulses, that is, the durability is lower. Therefore, by disposing the fulcrum of the movable member outside the right above position of the effective bubble generating region of the heat generating element, a movable member of a configuration and/or a material not providing very high durability can be practically usable. On the other hand, even if the fulcrum is right above the effective bubble generating region, it is practically usable if the configuration and/or the material is properly selected. By doing so, a liquid ejecting head with the high ejection energy use efficiency and the high durability can be provided.

Element Substrate

The description will be made as to a structure of the element substrate provided with the heat generating element for heating the liquid.

Figure 21A:
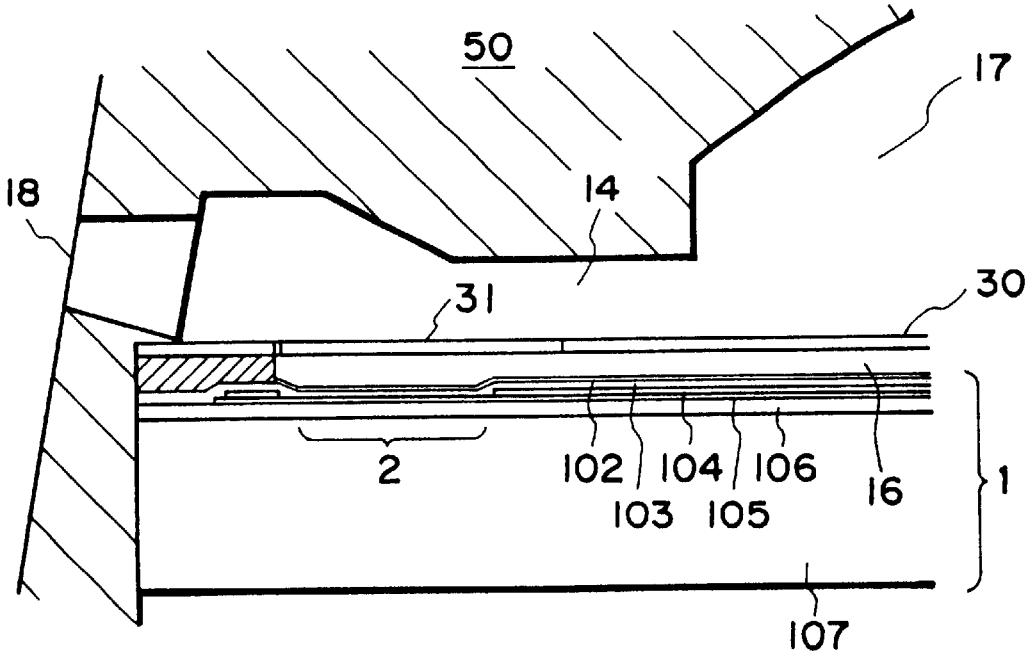
FIGS. 21(*a*) and 21(*b*) are longitudinal sections of a liquid ejecting head according to an embodiment of the present invention.
Figure 21B:
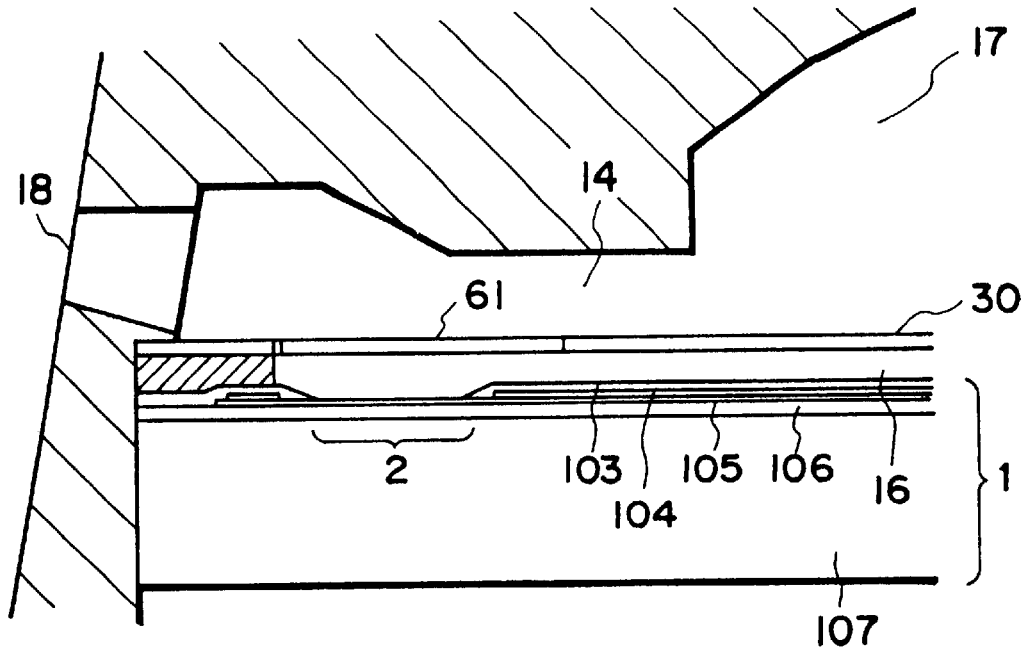

FIG. 21 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 21, patterned wiring electrode (0.2–1.0 μm thick) of aluminum or the like and patterned electric resistance layer 105 (0.01–0.2 μm thick) of hafnium boride ($HfB_2$), tantalum nitride(TaN), tantalum aluminum(TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer 103 of silicon oxide, silicon nitride or the like of 0.1–2.0 μm thick is provided on the resistance layer, and in addition, an anti-cavitation layer 102 of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated. Therefore, metal material such as tantalum (Ta) or the like is used as the anti-cavitation layer 102.

The protection layer may be omitted depending on the combination of liquid, liquid flow path structure and resistance material. One of such examples is shown in FIG. 5, (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 22:
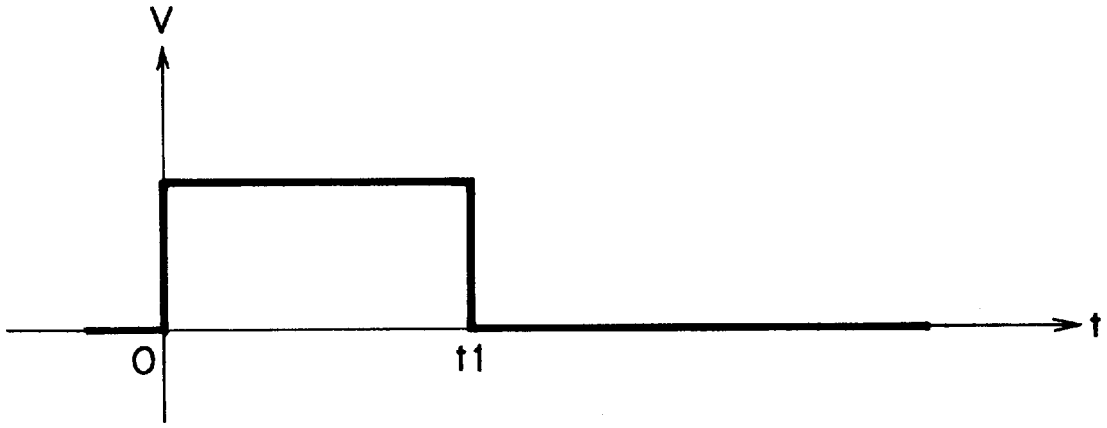
FIG. 22 is a schematic view of a configuration of a driving pulse.

In order to eject the liquid by driving the heat generation portion of the electrothermal transducer on the above-described element substrate 1, the resistance layer 105 is supplied through the wiring electrode 104 with rectangular pulses as shown in FIG. 22 to cause instantaneous heat generation in the resistance layer 105 between the wiring electrode. In the case of the heads of the foregoing embodiments, the applied energy has a voltage of 24V, a pulse width of 7 μsec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

Head Structure of 2 Flow Path Structure

The description will be made as to a structure of the liquid ejecting head with which different liquids are separately accommodated in first and second common liquid chamber, and the number of parts can be reduces so that the manufacturing cost can be reduced.

Figure 23:
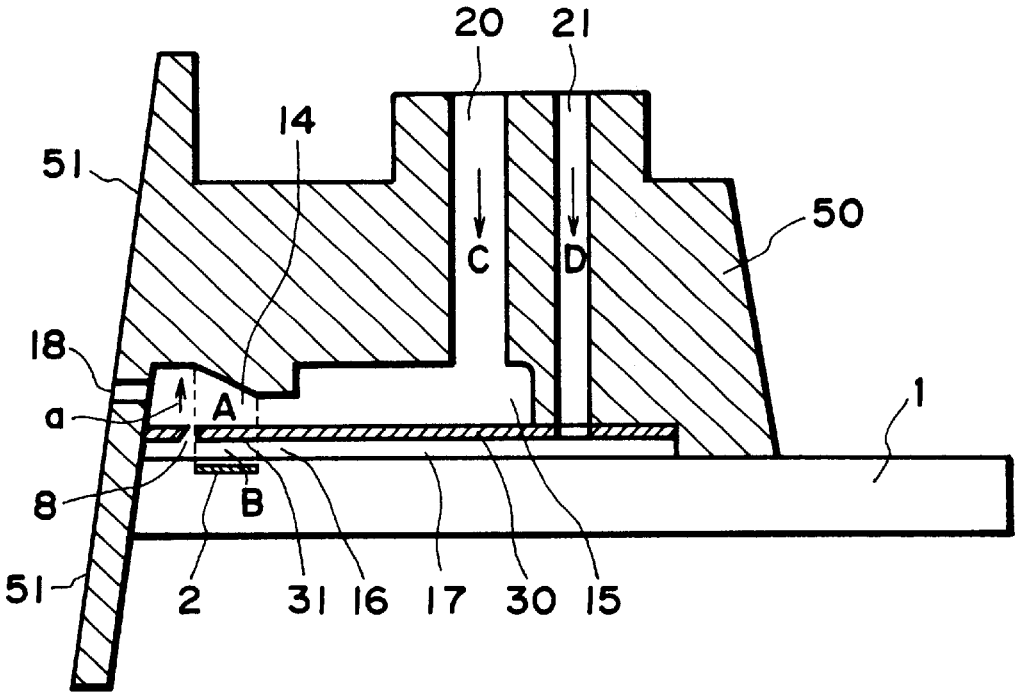
FIG. 23 is a sectional view of a supply passage of a liquid ejecting head in an embodiment of the present invention.

FIG. 23 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

A s indicated by an arrow C in FIG. 23, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 22.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

Figure 24:
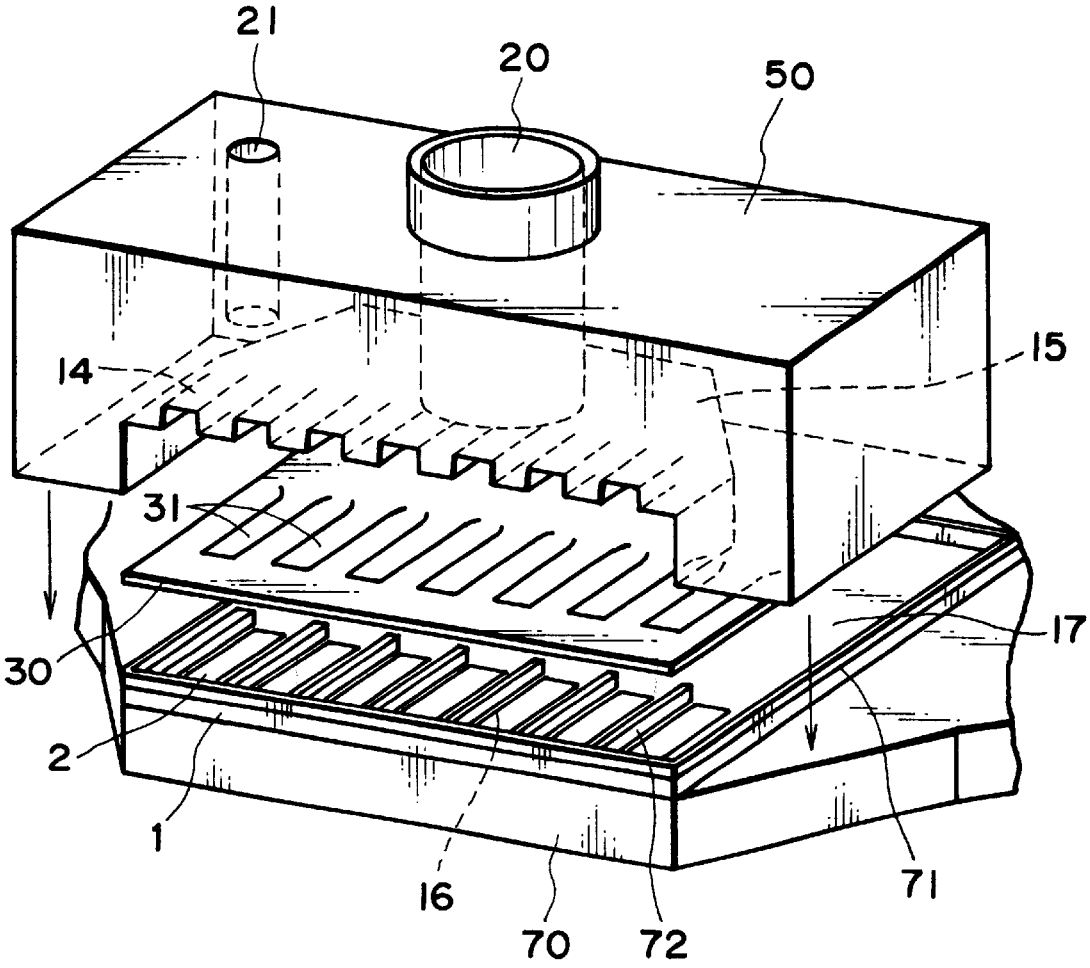
FIG. 24 is an exploded perspective view of a head of an embodiment of the present invention.
Figure 25A:
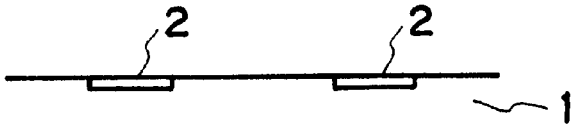
FIGS. 25(*a–e*) are a process chart of manufacturing method of a liquid ejecting head in an embodiment of the present invention.
Figure 25B:
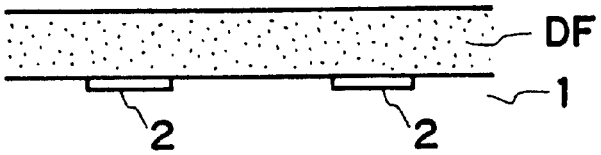
Figure 25C:
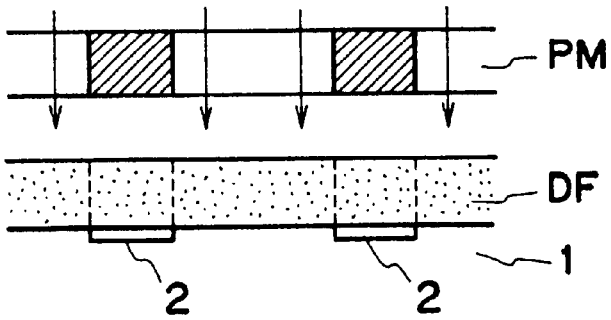
Figure 25D:
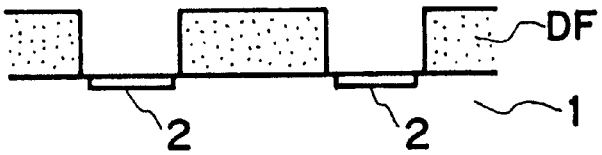
Figure 25E:
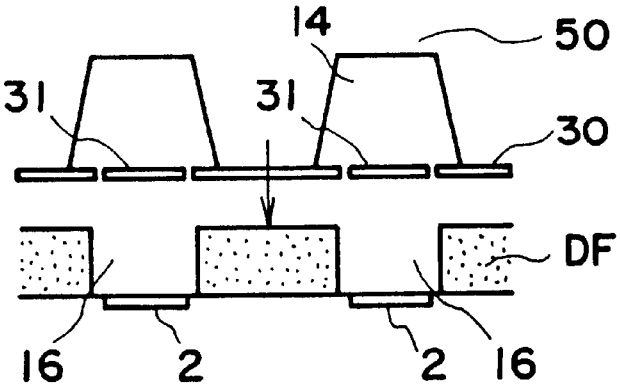
Figure 26A:
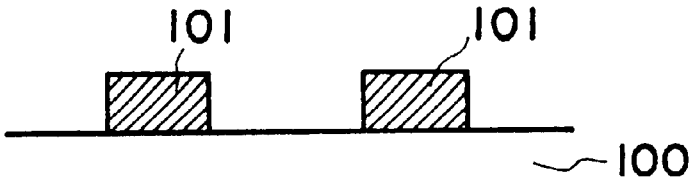
FIGS. 26(*a–d*) are a process chart of a manufacturing method of a liquid ejecting head according to an embodiment of the present invention.
Figure 26B:
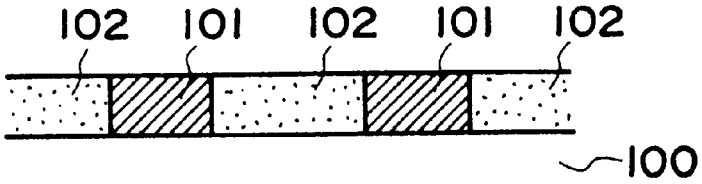
Figure 26C:
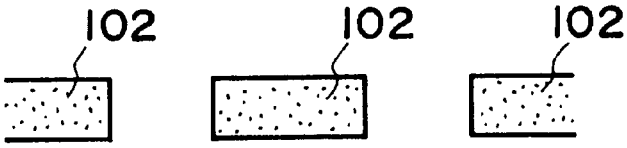
Figure 26D:
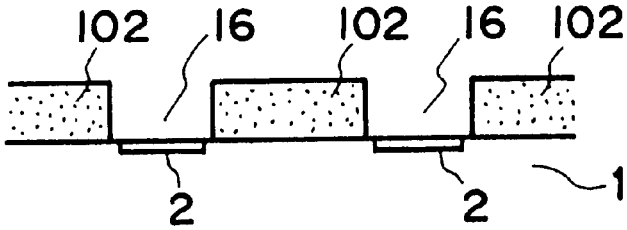
Figure 27A:
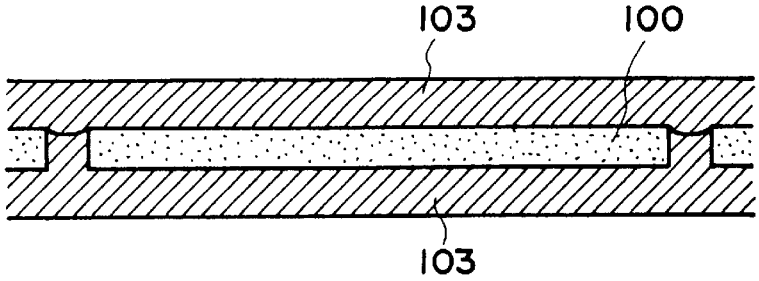
FIGS. 27(*a–d*) are a process chart of a manufacturing method of a liquid ejecting head according to an embodiment of the present invention.
Figure 27B:
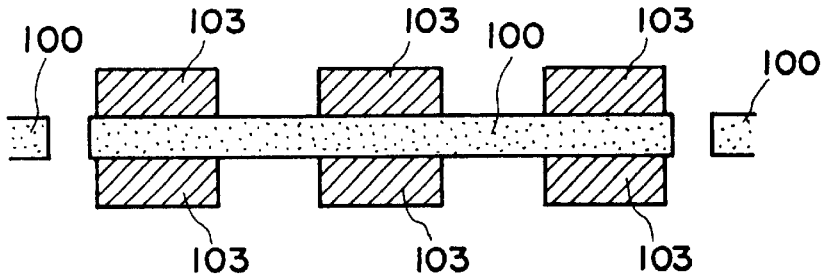
Figure 27C:
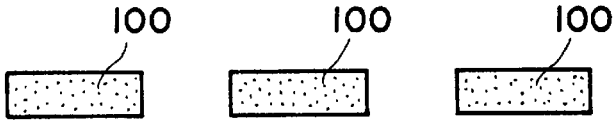
Figure 27D:
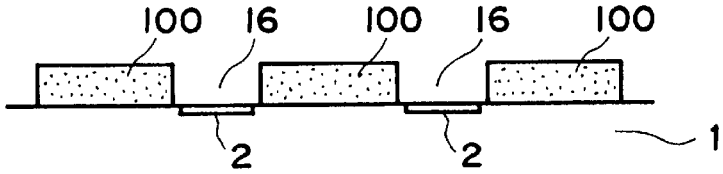

The second common liquid chamber 17 may be formed by dividing the grooved by a separation wall 30. As for the method of forming this, as shown in FIG. 24 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second supply passage (bubble generation liquid supply passage) 21. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

Ejection Liquid and Bubble Generation Liquid

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n- n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

Dye ink viscosity of 2 cp (C.I. food black 2) dye 3 wt. % diethylene glycol 10 wt. %

Thio diglycol 5 wt. %

Ethanol 5 wt. %

Water 77 wt. %

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

Bubble generation liquid 1:

Ethanol 40 wt. %

Water 60 wt. %

Bubble generation liquid 2:

Water 100 wt. %

Bubble generation liquid 3:

Isopropyl alcoholic 10 wt. %

Water 90 wt. %

Ejection liquid 1:

(Pigment ink approx. 15 cp)

Carbon black 5 wt. %

Stylene-acrylate-acrylate ethyl copolymer resin material 1 wt. %

Dispersion material (oxide 140, weight average molecular weight)

Mono-ethanol amine 0.25 wt. %

Glyceline 69 wt. %

Thiodiglycol 5 wt. %

Ethanol 3 wt. %

Water 16.75 wt. %

Ejection liquid 2 (55 cp):

Polyethylene glycol 200 100 wt. %

Ejection liquid 3 (150 cp):

Polyethylene glycol 600 100 wt. %

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

Manufacturing of Liquid Ejecting Head

The description will be made as to the manufacturing step of the liquid ejecting head according to the present invention.

In the case of the liquid ejecting head as shown in FIG. 3, a foundation 34 for mounting the movable member 31 is patterned and formed on the element substrate 1, and the movable member 31 is bonded or welded on the foundation 34. Then, a grooved member having a plurality of grooves for constituting the liquid flow paths 10, ejection outlet 18 and a recess for constituting the common liquid chamber 13, is mounted to the element substratel with the grooves and movable members aligned with each other.

The description will be made as to a manufacturing step for the liquid ejecting head having the two-flow-path structure as shown in FIG. 11 and FIG. 24.

Generally, walls for the second liquid flow paths 16 are formed on the element substratel, and separation walls 30 are mounted thereon, and then, a grooved member 50 having the grooves for constituting the first liquid flow paths 14, is mounted further thereon. Or, the walls for the second liquid flow paths 16 are formed, and a grooved member 50 having the separation walls 30 is mounted thereon.

The description will be made as to the manufacturing method for the second liquid flow path.

FIGS. 25, (*a*)–(*e*), is a schematic sectional view for illustrating a manufacturing method for the liquid ejecting head according to a first manufacturing embodiment of the present invention.

In this embodiment, as shown in FIG. 25, (*a*), elements for electrothermal conversion having heat generating elements 2 of hafnium boride, tantalum nitride or the like, are formed, using a manufacturing device as in a semiconductor manufacturing, on an element substrate (silicon wafer) 1, and thereafter, the surface of the element substrate 1 is cleaned for the purpose of improving the adhesiveness or contactness with the photosensitive resin material in the next step. In order to further improve the adhesiveness or contactness, the surface of the element substrate is treated with ultraviolet-radiation-ozone or the like. Then, liquid comprising a silane coupling agent, for example(A189, available from NIPPON UNICA) diluted by ethyl alcoholic to 1 weight % is applied on the improved surface by spin coating.

Subsequently, the surface is cleaned, and as shown in FIG. 25, (*b*), an ultraviolet radiation photosensitive resin film (dry film Ordyl SY-318 available from Tokyo Ohka Kogyo Co., Ltd.) DF is laminated on the substratel having the thus improved surface.

Then, as shown in FIG. 25, (*c*), a photo-mask PM is placed on the dry film DF, and the portions of the dry film DF which are to remain as the second flow passage wall is illuminated with the ultraviolet radiation through the photo-mask PM. The exposure process was carried out using MPA-600, available from, CANON KABUSHIKI KAISHA), and the exposure amount was approx. 600 $mJ/cm^2$.

Then, as shown in FIG. 25, (*d*), the dry film DF was developed by developing liquid which is a mixed liquid of xylene and butyl Cellosolve acetate (BMRC-3 available from Tokyo Ohka Kogyo Co., Ltd.) to dissolve the unexposed portions, while leaving the exposed and cured portions as the walls for the second liquid flow paths 16. Furthermore, the residuals remaining on the surface of the element substrate 1 is removed by oxygen plasma ashing device (MAS-800 available from Alcan-Tech Co., Inc.) For approx. 90 sec, and it is exposed to ultraviolet radiation for 2 hours at 150° C. with the dose of 100 mJ/cm$_2$ to completely cure the exposed portions.

By this method, the second liquid flow paths can be formed with high accuracy on a plurality of heater boards (element substrates) cut out of the silicon substrate. The silicon substrate is cut into respective heater boards 1 by a dicing machine having a diamond blade of a thickness of 0.05 mm (AWD-4000 available from Tokyo Seimitsu). The separated heater boards 1 are fixed on the aluminum base plate 70 by adhesive material (SE4400 available from Toray), FIG. 20. Then, the printed board 71 connected to the aluminum base plate 70 beforehand is connected with the heater board 1 by aluminum wire (not shown) having a diameter of 0.05 mm.

As shown in FIG. 25, (*e*), a joining member of the grooved member 50 and separation wall 30 were positioned and connected to the heater board 1. More particularly, grooved member having the separation wall 30 and the heater board 1 are positioned, and are engaged and fixed by a confining spring. Thereafter, the ink and bubble generation liquid supply member 80 is fixed on the ink. Then, the gap among the aluminum wire, grooved member 50, the heater board1 and the ink and bubble generation liquid supply member 80 are sealed by a silicone sealant (TSE399, available from Toshiba silicone).

By forming the second liquid flow path through the manufacturing method, accurate flow paths without positional deviation relative to the heaters of the heater board, can be provided. By coupling the grooved member 50 and the separation wall 30 in the prior step, the positional accuracy between the first liquid flow path 14 and the movable member 31 is enhanced.

By the high accuracy manufacturing technique, the ejection stabilization is accomplished, and the printing quality is improved. Since they are formed all together on a wafer, massproduction at low cost is possible.

In this embodiment, the use is made with an ultraviolet radiation curing type dry film for the formation of the second liquid flow path. But, a resin material having an absorption band adjacent particularly 248 nm (outside the ultraviolet range) may be laminated. It is cured, and such portions going to be the second liquid flow paths are directly removed by eximer laser.

FIGS. 26, (*a*)–(*d*), is a schematic sectional view for illustration of a manufacturing method of the liquid ejecting head according to a second embodiment of the present invention.

In this embodiment, as shown in FIG. 26, (*a*), a resist 101 having a thickness of 15 μm is patterned in the shape of the second liquid flow path on the SUS substrate 100.

Then, as shown in FIG. 26, (*b*), the SUS substrate 20 is coated with 15 μm thick of nickel layer 102 on the SUS substrate 100 by electroplating. The plating solution used comprised nickel amidosulfate nickel, stress decrease material (zero ohru, available from World Metal Inc.), boric acid, pit prevention material (NP-APS, available from World Metal Inc.) and nickel chloride. As to the electric field upon electro-deposition, an electrode is connected on the anode side, and the SUS substrate 100 already patterned is connected to the cathode, and the temperature of the plating solution is 50° C., and the current temperature is 5 A/cm$^2$.

Then, as shown in FIG. 26, (*c*), the SUS substrate 100 having been subjected to the plating is subjected then to ultrasonic vibration to remove the nickel layer 102 portions from the SUS substrate 100 to provide the second liquid flow path.

On the other hand, the heater board having the elements for the electrothermal conversion, are formed on a silicon wafer by a manufacturing device as used in semiconductor manufacturing. The wafer is cut into heater boards by the dicing machine similarly to the foregoing embodiment. The heater board 1 is mounted to the aluminum base plate 70 already having a printed board 104 mounted thereto, and the printed board 7 and the aluminum wire (not shown) are connected to establish the electrical wiring. On such a heater board 1, the second liquid flow path provided through the foregoing process is fixed, as shown in FIG. 26, (*d*). For this fixing, it may not be so firm if a positional deviation does not occur upon the top plate joining, since the fixing is accomplished by a confining spring with the top plate having the separation wall fixed thereto in the later step, as in the first embodiment.

In this embodiment, for the positioning and fixing, the use was made with an ultraviolet radiation curing type adhesive material (Amicon UV-300, available from GRACE JAPAN, and with an ultraviolet radiation projecting device operated with the exposure amount of 100 mJ/cm$^2$ for approx. 3 sec to complete the fixing.

According to the manufacturing method of this embodiment, the second liquid flow paths can be provided without positional deviation relative to the heat generating elements, and since the flow passage walls are of nickel, it is durable against the alkali property liquid so that the reliability is high.

FIGS. 26, (*a*)–(*d*), is a schematic sectional view for illustrating a manufacturing method of the liquid ejecting head according to a third embodiment of the present invention.

In this embodiment, as shown in FIG. 26, (*a*), the resist 31 is applied on both of the sides of the SUS substrate 100 having a thickness of 15 μm and having an alignment hole or mark 100*a*. The resist used was PMERP-AR900 available from Tokyo Ohka Kogyo Co., Ltd.

Thereafter, as shown in (*b*), the exposure operation was carried out in alignment with the alignment hole 100*a* of the element substrate 100, using an exposure device (MPA-600 available from CANON KABUSHIKI KAISHA, JAPAN) to remove the portions of the resist 103 which are going to be the second liquid flow path. The exposure amount was 800 mJ/cm$^2$.

Subsequently, as shown in (*c*), the SUS substrate 100 having the patterned resist 103 on both sides, is dipped in etching liquid (aqueous solution of ferric chloride or cuprous chloride) to etch the portions exposed through the resist 103, and the resist is removed.

Then, as shown in (*d*), similarly to the foregoing embodiment of the manufacturing method, the SUS substrate 100 having been subjected to the etching is positioned and fixed on the heater board1, thus assembling the liquid ejecting head having the second liquid flow paths 4.

According to the manufacturing method of this embodiment, the second liquid flow paths 4 without the positional deviation relative to the heaters can be provided, and since the flow paths are of SUS, the durability against acid and alkali liquid is high, so that high reliability liquid ejecting head is provided.

As described in the foregoing, according to the manufacturing method of this embodiment, by mounting the walls of the second liquid flow path on the element substrate in a prior step, the electrothermal transducers and second liquid flow paths are aligned with each other with high precision. Since a number of second liquid flow paths are formed simultaneously on the substrate before the cutting, massproduction is possible at low cost.

The liquid ejecting head provided through the manufacturing method of this embodiment has the advantage that the second liquid flow paths and the heat generating elements are aligned at high precision, and therefore, the pressure of the bubble generation can be received with high efficiency so that the ejection efficiency is excellent.

Liquid Ejection Head Cartridge

The description will be made as to a liquid ejection head cartridge having a liquid ejecting head according to an embodiment of the present invention.

Figure 28:
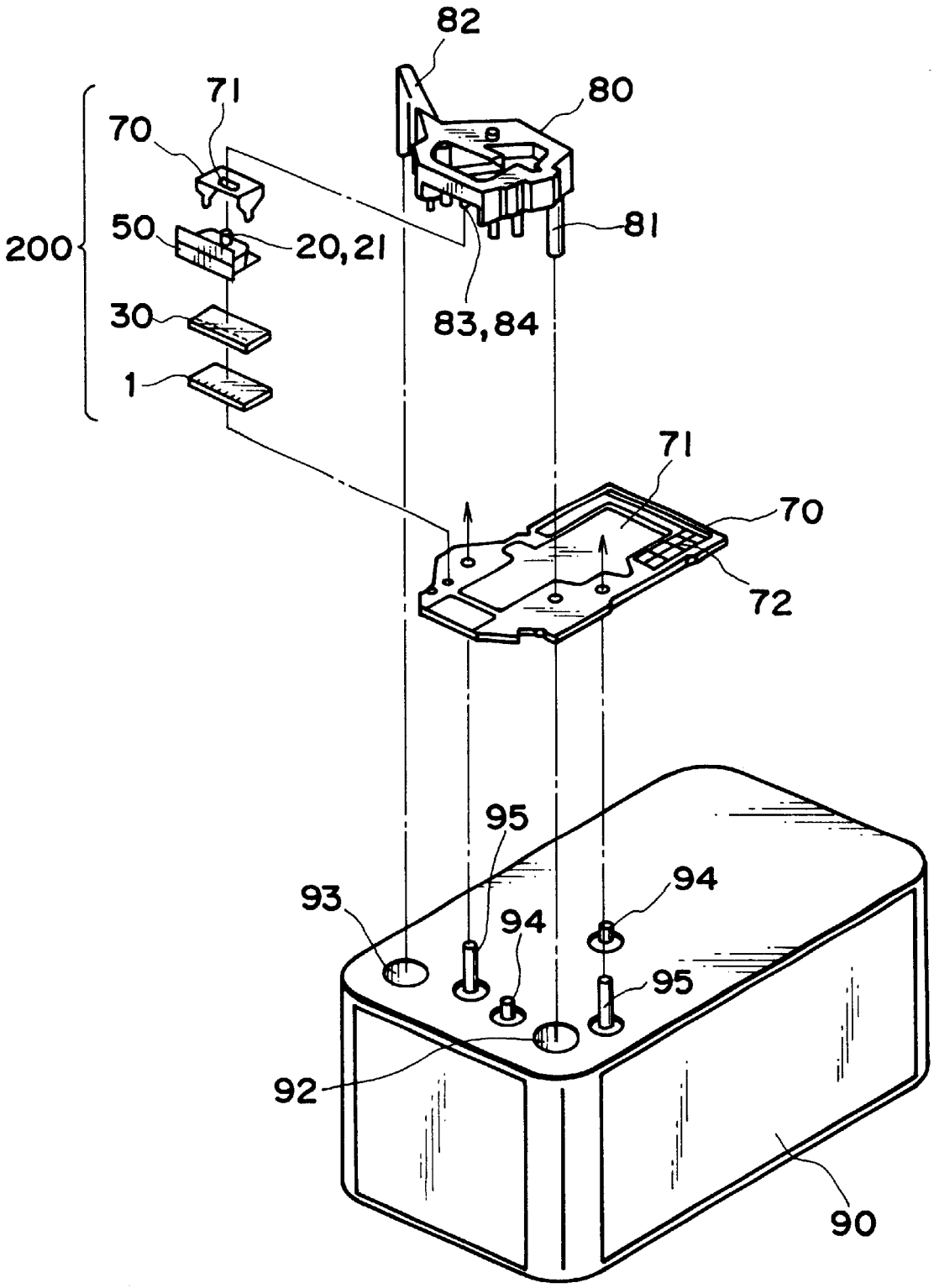
FIG. 28 is an exploded perspective view of a liquid ejection head cartridge.

FIG. 28 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 70, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 70 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 81 of the connecting member from the ejection liquid supply passage 92 of the liquid container, and is supplied to a first common liquid chamber through the ejection liquid supply passage 83, supply and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In such a liquid ejection head cartridge, even if the bubble generation liquid and the ejection liquid are different liquids, the liquids are supplied in good order. In the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

Liquid Ejecting Device

Figure 29:
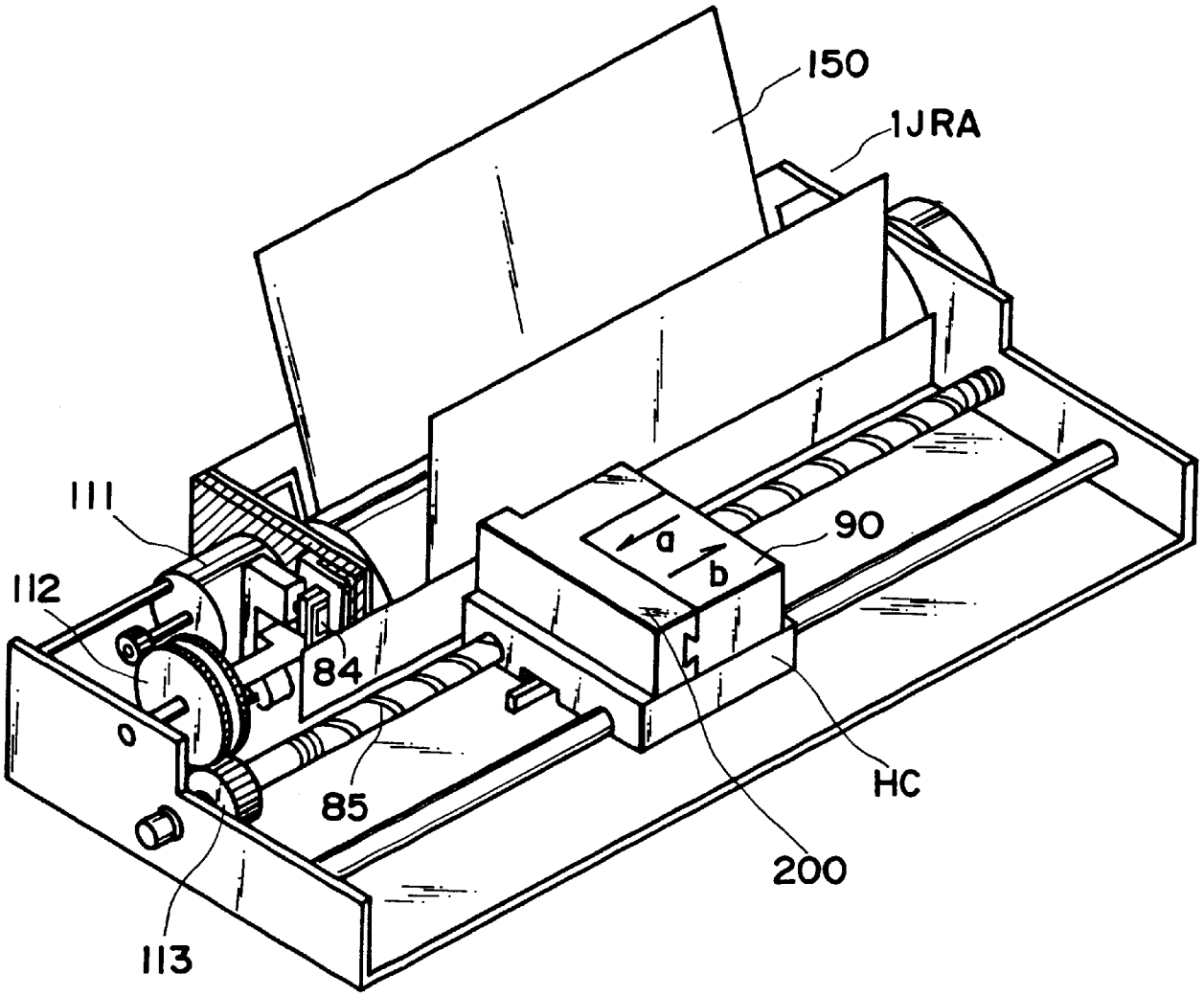
FIG. 29 is a schematic illustration of a liquid ejecting device.

FIG. 29 is a schematic illustration of a liquid ejecting device used with the above-described liquid ejecting head. In this embodiment, the ejection liquid is ink, and the apparatus is an ink ejection recording apparatus. The liquid ejecting device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 30:
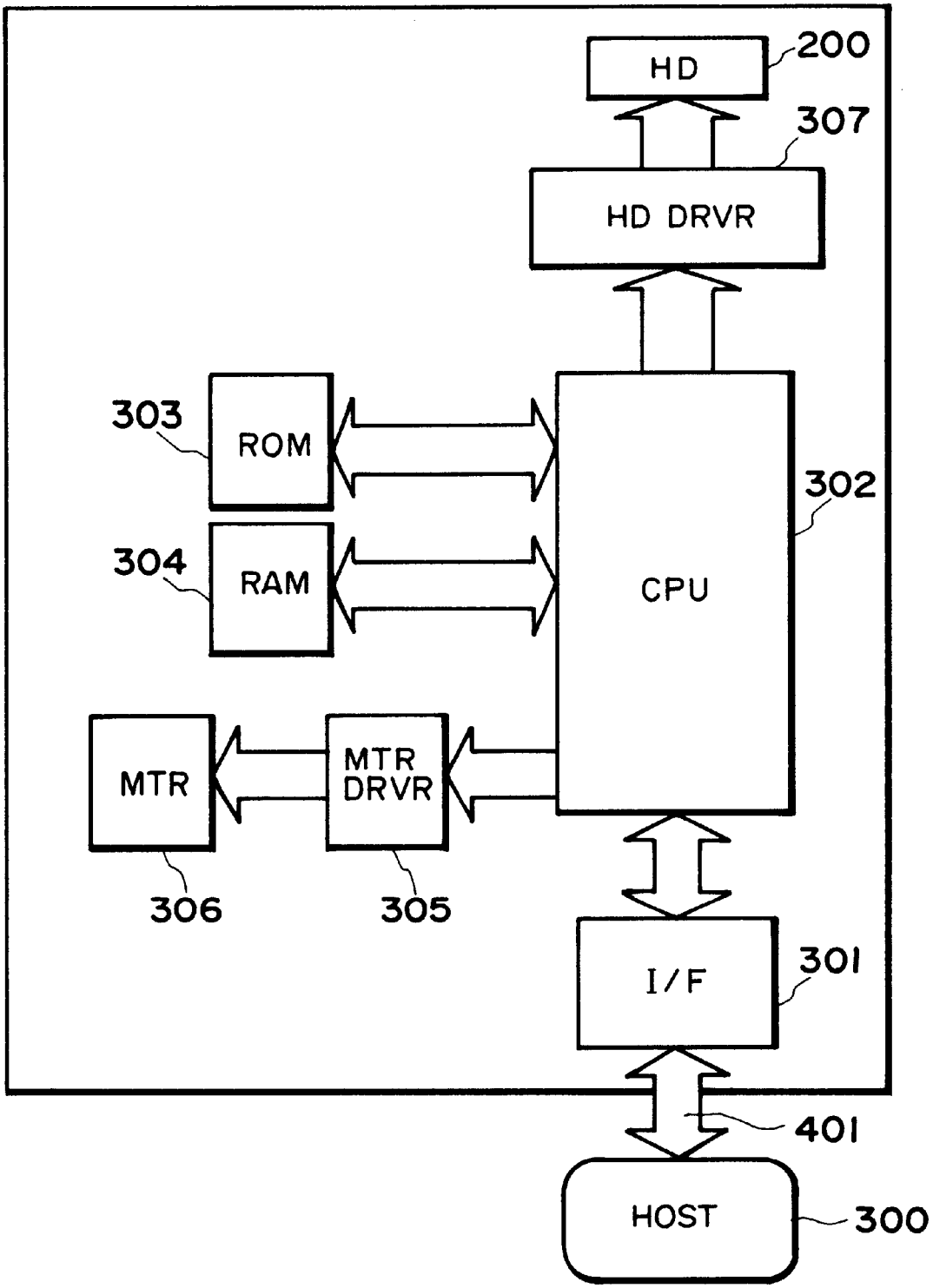
FIG. 30 is a blockdiagram of an apparatus.

FIG. 30 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

Recording System

Next, an exemplary ink jet recording system will be described, which records images on recording medium, using, as the recording head, the liquid ejection head in accordance with the present invention.

Figure 31:
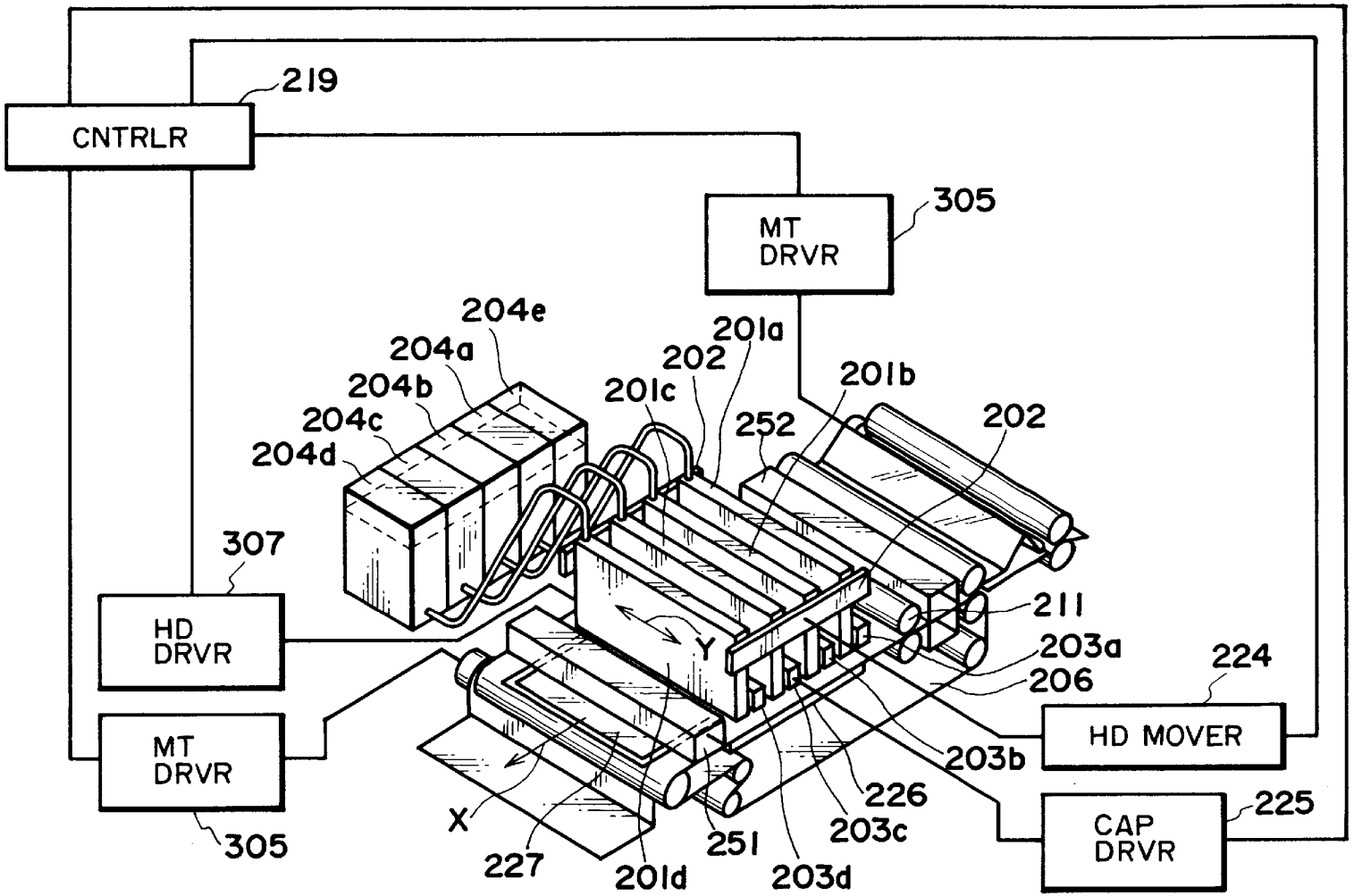
FIG. 31 is a schematic view of a liquid ejection recording system.

FIG. 31 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a*, 204*b*, 205*c* or 204*d*. A reference numeral 204*e* designates a bubble generation liquid container from which the bubble generation liquid is delivered to each head.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultraviolet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

Head Kit

Figure 32:
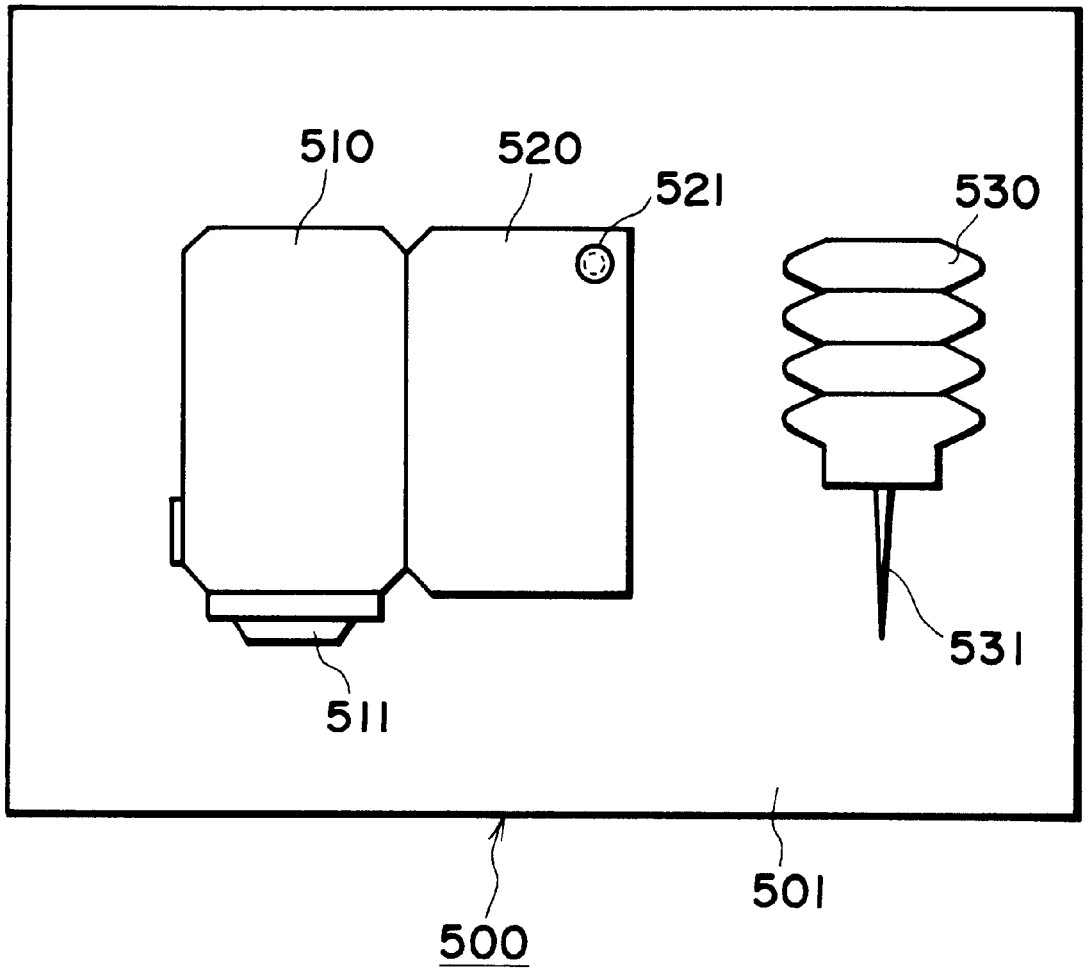
FIG. 32 is a schematic view of a head kit.

Hereinafter, a head kit will be described, which comprises the liquid ejection head in accordance with the present invention. FIG. 32 is a schematic view of such a head kit. This head kit is in the form of a head kit package 501, and contains: a head 510 in accordance with the present invention, which comprises an ink ejection section 511 for ejecting ink; an ink container 510, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid ejection head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Even though FIG. 32 illustrates only the ink filling means for filling the printing ink into the ink container, the head kit may contain means for filling the bubble generation liquid into the bubble generation liquid container, in addition to the printing ink refilling means.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting method for ejecting liquid by generation of a bubble, comprising the steps of:

preparing a head comprising an ejection outlet for ejecting the liquid, a heat generating element for generating heat to form the bubble, the heat generating element including a resistance layer and a pair of electrodes, the electrodes being connected to the resistance layer, a heat generating surface of said heat generating element being substantially flush with or smoothly continuous with an upstream surface adjacent to said heat generating surface, the heat generating surface being provided between the electrodes, a bubble generation region where the bubble is generated in the liquid, a movable member having a fulcrum and a free end located downstream of the fulcrum relative to a direction of flow of the liquid, the movable member being disposed faced to said bubble generation region and is displaceable between a first position and a second position that is further from said bubble generation region than the first position;

generating a bubble by applying energy to the heat generating element; and displacing said movable member from said first position to said second position by pressure produced by generation of the bubble in said bubble generating portion to permit expansion of the bubble more in a downstream side nearer to the ejection outlet than in an upstream side.

2. A method according to claim 1, wherein the bubble expands beyond the first position and moves the movable member to the second position.

3. A method according to claim 1, wherein movement of the movable member allows the downstream portion of the bubble to grow downstream towards the movable member.

4. A method according to claim 1, wherein the movable member has a free end at a position downstream of the fulcrum, and the free end is moved by a deflection of the movable member with the fulcrum fixed.

5. A head according to claim 1, wherein the free end of said movable member is disposed faced to said heat generating element and downstream of an area center of said head generating element.

6. A head according to claim 5, wherein said liquid flow path has a supply passage for supplying the liquid to said heat generating element from upstream thereof along the heat generating element.

7. A head according to claim 6, wherein said liquid flow path has an internal wall which is substantially flat or smoothly curved, and the supply passage is supplied to said heat generating element along the internal wall.

8. A head according to claim 5, further comprising a liquid flow path for supplying the liquid to said heat generating element from the upstream thereof along a side of said movable member faced to said heat generating element.

9. A method according to claim 1, further comprising:

a heat generating element for heating the liquid, wherein a portion of the movable member corresponding to an area center of the heat generating element is displaceable.

10. A liquid ejecting method for ejecting a liquid by generation of a bubble, comprising the steps of:

supplying the liquid along a heat generating element disposed along a flow path from upstream of the heat generating element, the heat generating element including a resistance layer and a pair of electrodes, the electrodes being connected to the resistance layer, and a surface of said heat generating element is substantially flush with or smoothly continuous with a surface of said flow path at an upstream end portion of said heat generating element, the heat generating surface being provided between the electrodes;

applying heat generated by the heat generating element to the thus supplied liquid to generate a bubble; moving a free end of a movable member having the free end located downstream of a fulcrum relative to a direction of flow of the liquid, and adjacent to the ejection outlet side in response to pressure produced by the generation of the bubble, said movable member being disposed faced to said heat generating element; and guiding the pressure toward the ejection outlet by the movement of the movable member to eject the liquid.

11. A method according to claim 10, wherein the bubble is generated by a film boiling caused by transferring heat generated by a heat generating element to the liquid.

12. A method according to claim 10, wherein the liquid is supplied to the heat generating element along an internal wall which is substantially flat or smoothly curved.

13. A method according to claim 5, wherein a portion of the movable member corresponding to an area center of the heat generating element is displaceable.

14. A liquid ejecting method for ejecting liquid by generation of a bubble, comprising the steps of:

preparing a head including a first liquid flow path in fluid communication with a liquid ejection outlet, a heat generating element for generating heat to form the bubble, the heat generating element including a resistance layer and a pair of electrodes, the electrodes being connected to the resistance layer, a heat generating surface of said heat generating element being substantially flush with or smoothly continuous with an upstream surface adjacent to said heat generating surface, the heat generating surface being provided between the electrodes, a second liquid flow path having a bubble generation region and a movable member disposed between said first liquid flow path and said bubble generation region and having a fulcrum and a free end located downstream of the fulcrum relative to a direction of flow of the liquid, adjacent the ejection outlet side; and generating a bubble in said bubble generation region;

displacing the free end of the movable member into said first-liquid flow path in response to pressure produced by the generation of the bubble; and guiding the pressure toward the ejection outlet of said first liquid flow path by the movement of the movable member to eject the liquid.

15. A method according to claim 14, wherein a part of the bubble generated expands into the first liquid flow path with movement of the movable member.

16. A method according to claim 14, wherein the liquid supplied to the first liquid flow path is the same as the liquid supplied to the second liquid flow path.

17. A method according to claim 10 or 14, wherein the free end is disposed downstream of a center of an area of the heat generating element with respect to a flow direction of the liquid.

18. A method according to claim 1 or 14, wherein a heat generating element for generating the bubble is disposed faced to the movable member, and said bubble generation region is formed between the movable member and the heat generating element.

19. A method according to claim 18, wherein the downstream portion of the bubble is generated by a downstream portion of an area center of the heat generating element faced to the movable member.

20. A method according to claim 18, wherein the free end is disposed downstream of a center of an area of the heat generating element with respect to a flow direction of the liquid.

21. A method according to claim 18, wherein the bubble is generated by a film boiling caused by transferring heat generated by a heat generating element to the liquid.

22. A method according to claim 18, wherein the liquid is supplied to the heat generating element along an internal wall which is substantially flat or smoothly curved.

23. A method according to claim 1 or 10, wherein a state of contact of the bubble with the movable member occurs during movement of the movable member.

24. A method, according to claim 4, 10 or 14, wherein said free end has a free end edge faced to an ejection outlet side.

25. A liquid ejecting head for ejecting liquid by generation of bubble, comprising:

a liquid flow path for the liquid;

an ejection outlet for ejecting the liquid;

a heat generating element for generating heat to form the bubble, the heat generating element including a resistance layer and a pair of electrodes, the electrodes being connected to the resistance layer, a heat generating surface of said heat-generating element being substantially flush with or smoothly continuous with an upstream surface adjacent to said heat generating surface, the heat generating surface being provided between the electrodes;

a bubble generation region disposed in the flow path where the bubble is generated in the liquid;

a movable member having a fulcrum and a free end located downstream of the fulcrum relative to a direction of flow of the liquid, the movable member being disposed faced to said bubble generation region and displaceable between a first position and a second position further from said bubble generation region than the first position;

wherein said movable member moves from said first position to said second position by pressure produced by the generation of the bubble more in a downstream side nearer to the ejection outlet than in an upstream side.

26. A head according to claim 25, wherein a heat generating element for generating the bubble is disposed faced to the movable member, and said bubble generation region is formed between the movable member and the heat generating element.

27. A head according to claim 25, wherein by the movement of the movable member allows the downstream portion of the bubble to grow downstream toward the movable member.

28. A head according to claim 25, wherein said liquid flow path includes a supply passage for supplying the liquid to said heat generating element from upstream thereof along the heat generating element.

29. A head according to claim 28, wherein the liquid is supplied to the heat generating element along an internal wall which is substantially flat or smoothly curved.

30. A head according to claim 25, wherein the liquid flow path supplies the liquid to said heat generating element from upstream thereof along a surface of said movable member close to said heat generating element.

31. A head according to claim 25, further comprising:

a heat generating element for heating the liquid, wherein said heat generating element and said movable member are faced to each other with said bubble generating region therebetween, and said movable member is disposed such that a portion of the movable member corresponding to an area center of the heat generating element is displaceable.

32. A head according to claim 25, wherein said heat generating element and said movable member are faced to each other with said bubble generating region therebetween, and the fulcrum is disposed upstream of an area center of said heat generating element, and the free end is disposed downstream of the area center.

33. A liquid ejecting head for ejecting liquid by generation of bubble, comprising:

an ejection outlet for ejecting the liquid;

a heat generating element for generating the bubble in the liquid by applying heat to said liquid, the heat generating element having an area center,;

a liquid flow path having a supply passage for supplying the liquid to said heat generating element from upstream thereof, a surface of said heat generating element is substantially flush with or smoothly continuous with a surface of said flow path at an upstream end portion of said heat generating element; and a movable member disposed faced to said heat generating element and having a fulcrum and a free end located downstream of the fulcrum relative to a direction of flow of the liquid, a portion of the movable member corresponding to the area center of the heat generating element being displaceable, adjacent said ejection outlet, the free end of said movable member being moved by pressure produced by the generation of the bubble to guide the pressure toward said ejection outlet.

34. A head according to claim 33, wherein said liquid flow path has an internal wall which is substantially flat or smoothly curved, and the supply passage is supplied to said heat generating element along the internal wall.

35. A head according to claim 33, wherein said heat generating element and said movable member are faced to each other with said bubble generating region therebetween, and said movable member is disposed such that a portion of the movable member corresponding to an area center of the heat generating element is displaceable.

36. A liquid ejecting head for ejecting liquid by generation of a bubble, comprising:

an ejection outlet for ejecting the liquid;

a heat generating element for generating the bubble in the liquid by applying heat to said liquid, the heat generating element having an area center;

a movable member disposed faced to said heat generating element and having a fulcrum and a free end located downstream of the fulcrum relative to a direction of flow of the liquid, a portion of the movable member corresponding to the area center of the heat generating element being displaceable, adjacent said ejection outlet, the free end of said movable member being moved by pressure produced by the generation of the bubble to guide the pressure toward said ejection outlet; and a liquid flow path for supplying the liquid to said heat generating element from upstream along such a side of said movable member as is nearer to said heat generating element, a surface of said movable member is substantially flush with or smoothly continuous with a surface of said flow path at an upstream end portion of said heat generating element.

37. A head according to claim 36, wherein a distance between a surface of said heat generating element and said movable member, is not more than 30 $\mu$m.

38. A head according to claim 36, the liquid ejected through said ejection outlet is ink.

39. A head according to claim 36, wherein said heat generating element and said movable member are faced to each other with said bubble generating region therebetween, and said movable member is disposed such that a portion of the movable member corresponding to an area center of the heat generating element is displaceable.

40. A liquid ejecting head for ejecting liquid by generation of bubble, comprising:

a first liquid flow path in fluid communication with an ejection outlet;

a heat generating element for generating heat to form the bubble, the heat generating element having an area center;

a second liquid flow path having bubble generation region for generating the bubble in the liquid by applying heat to the liquid;

a movable member disposed between said first liquid flow path and said bubble generation region and having a fulcrum and a free end located downstream of the fulcrum relative to a direction of flow of the liquid, a portion of the movable member corresponding to the area center of the heat generating element being displaceable adjacent the ejection outlet, wherein the free end of the movable member is displaced into said first liquid flow path by pressure produced by the generation of the bubble, thus guiding the pressure toward the ejection outlet of said first liquid flow path by the movement of the movable member to eject the liquid.

41. A head according to claim 40, wherein a heat generating element for generating the bubble is disposed faced to the movable member, and said bubble generation region is formed between the movable member and the heat generating element.

42. A head according to claim 41, wherein said second liquid flow path has an internal wall which is substantially flat or smoothly curved, and the supply passage is supplied to said heat generating element along the internal wall.

43. A head according to claim 41, wherein the free end is disposed downstream of a center of an area of the heat generating element with respect to a flow direction of the liquid.

44. A head according to claim 41, wherein said movable member is disposed such that a portion of the movable member corresponding to an area center of the heat generating element is displaceable.

45. A head according to claim 25, 33, 36 or 41, wherein said movable member is in the form of a plate.

46. A head according to claim 45, wherein all of effective bubble generation region of said heat generating element is faced to said movable member.

47. A head according to claim 45, wherein all of the surface of said heat generating element is faced to said movable member.

48. A head according to claim 45, wherein a total area of said movable member is larger than a total area of said heat generating element.

49. A head according to claim 45, wherein a fulcrum of said movable member is at a position out of a portion right above said heat generating element.

50. A head according to claim 45, wherein the free end of said movable member has a portion extending in a direction substantially perpendicular to the liquid flow path having said heat generating element.

51. A head according to claim 45, wherein said free end of said movable member is disposed at a position nearer to said ejection outlet than said heat generating element.

52. A liquid ejection recording method wherein recording liquid is ejected by generation of a bubble to effect recording, comprising the step of:

preparing a head including an ejection outlet for ejecting the recording liquid, a heat generating element for generating heat to form the bubble, the heat generating element including a resistance layer and a pair of electrodes, the electrodes being connected to the resistance layer, a heat generating surface of said heat generating element being substantially flush with or smoothly continuous with an upstream surface adjacent to said heat generating surface, the heat generating surface being provided between the electrodes, a bubble generation region for generating the bubble in the liquid, a movable member having a fulcrum and a free end located downstream of the fulcrum relative to a direction of flow of the liquid, the free end being disposed at a position downstream of the fulcrum, the movable member being disposed faced to said bubble generation region and displaceable between a first position and a second position further from said bubble generation region than the first position;

wherein said movable member moves from said first position to said second position by pressure produced by the generation of the bubble to permit expansion of the bubble more in a downstream side nearer to the ejection outlet than in an upstream side to eject the recording liquid.

53. An ink ejection recording method wherein a recording ink is ejected by generation of a bubble to effect recording, comprising the steps of:

supplying the recording ink along a heat generating element, disposed along a flow path from upstream of the heat generating element, a contour of the liquid flow path not changing substantially by the heat generating element, wherein the heat generating element includes a resistance layer and a pair of electrodes, and the electrodes are connected to the resistance layer, and a heat generating surface is provided between the electrodes; and applying heat generated by the heat generating element to the thus supplied ink to generate a bubble, thus moving a free end of a movable member having a fulcrum and the free end located downstream of the fulcrum relative to a direction of flow of the liquid by pressure produced by the generation of the bubble, to eject the ink to the recording material, said movable member being disposed faced to said heat generating element.

54. An ink ejection recording method wherein recording ink is ejected by generation of a bubble to effect recording, comprising the steps of:

preparing a head including a first ink flow path in fluid communication with an ink ejection outlet, a heat generating element for generating heat to form the bubble, the heat generating element including a resistance layer and a pair of electrodes, the electrodes being connected to the resistance layer, a heat generating surface of said heat generating element being substantially flush with or smoothly continuous with an upstream surface adjacent to said heat generating surface, the heat generating surface being provided between the electrodes, a second ink flow path having a bubble generation region and a movable member disposed between said first ink flow path and said bubble generation region and having a fulcrum and a free end located downstream of the fulcrum relative to a direction of flow of the liquid;

generating a bubble in said bubble generation region to displace the free end of the movable member into said first ink flow path by pressure produced by the generation of the bubble; and guiding the pressure toward the ejection outlet of said first ink flow path by the movement of the movable member to eject the recording ink to a recording material.

55. A recorded material characterized by being recorded by ejected ink through a liquid ejection recording method as defined in claim 52, 53 or 54.

56. A liquid ejecting head according to claim 20, wherein said heat generating element is provided with a protection layer for protecting said resistance layer and said pair of electrodes.

57. A high speed liquid filling method for a liquid ejecting head, comprising the steps of:

preparing a liquid ejecting head including an ejection outlet for ejecting the liquid; a heat generating element for generating heat to form the bubble, wherein the heat generating element includes a resistance layer and a pair of electrodes, and the electrodes are connected to the resistance layer, and a heat generating surface is provided between the electrodes, a liquid flow path provided with the heat generating element for generating the bubble in the liquid by applying heat to said liquid, a contour of the flow path not changing substantially by the heat generating element; a movable member disposed faced to said heat generating element and having a fulcrum and a free end located downstream of the fulcrum relative to a direction of flow of the liquid, wherein a portion of the movable member corresponding to an area center of the heat generating element and the free end of said movable member being moved by pressure produced by the generation of the bubble to guide the pressure toward said ejection outlet; and supplying the liquid along the liquid flow path toward the heat generating element toward said ejection outlet and to the position of said heat generating element by restoration of the portion and the free end of the movable member to their initial position upon collapse of the bubble.

58. A method for removing a residual bubble in a liquid ejecting head, comprising the steps of:

preparing a liquid ejecting head as in claims 1 or 10;

displacing said movable member from the first position to the second position by pressure produced by the generation of the bubble in said bubble generation portion;

returning said movable member from said second position to the first position by collapse of the bubble; and supplying the liquid to said heat generating member along said heat generating element from upstream thereof to remove the residual bubble on said heat generating means.

59. A liquid droplet ejecting method for ejecting a liquid droplet through an ejection outlet by a bubble generated by film boiling from a heat generating element for generating heat to form the bubble, the heat generating element including a resistance layer and a pair of electrodes, the electrodes being connected to the resistance layer, a heat generating surface of said heat generating element being substantially flush with or smoothly continuous with an upstream surface adjacent to said heat generating surface, the heat generating surface being provided between the electrodes, comprising the steps of:

providing a movable member having a fulcrum, a movable surface and a free end located downstream of the fulcrum relative to a direction of flow of the liquid; and moving the free end by a part of a bubble providing at least a pressure component directly contributable to the liquid droplet ejection to guide said part toward the ejection outlet.

60. A liquid droplet ejecting method according to claim 59, wherein a leading edge region including the free end of said movable member is movable between a first position wherein the bubble generation region for generating the bubble through the film boiling is substantially sealed relative to said ejection outlet, and a second position wherein the bubble generation region is opened relative to said ejection outlet.

61. A method according to claim 59, wherein opposite lateral end regions of said movable member is movable between a first position wherein the bubble generation region for generating the bubble through the film boiling is substantially sealed relative to said ejection outlet, and a second position wherein the bubble generation region is opened relative to said ejection outlet.

62. A method according to claim 59, wherein said movable member is moved also by a pressure component not acting in a liquid ejecting direction.

63. A liquid droplet ejecting method for ejecting a liquid droplet through an ejection outlet disposed at a position not faced to a bubble generation region and downstream of the bubble generation region with respect to a liquid droplet ejection direction, comprising the steps of:

generating a bubble in the bubble generation region using a heat generating element for generating heat to form the bubble, the heat generating element including a resistance layer and a pair of electrodes, the electrodes being connected to the resistance layer, a heat generating surface of said heat generating element being substantially flush with or smoothly continuous with an upstream surface adjacent to said heat generating surface, the heat generating surface being provided between the electrodes;

providing a movable member having a fulcrum and a free end portion located downstream of the fulcrum relative to a direction of flow of the liquid, for substantially sealing an ejection outlet side region of said bubble generation region relative to said ejection outlet and a surface portion extending from the free end portion to a fulcrum portion which is disposed away from the free end in a direction away from said ejection outlet; and moving said free end from its substantial sealing position by the generating of the bubble to open said bubble generation region to the ejection outlet to eject the liquid droplet.

64. A method according to claim 63, wherein the bubble generated in said bubble generation region is guided by said free end portion toward said ejection outlet side.

65. A method according to claim 63, wherein opposite lateral end regions of said movable member are movable between a first position wherein the bubble generation region for generating the bubble through the film boiling is substantially sealed relative to said ejection outlet, and a second position wherein the bubble generation region is opened relative to said ejection outlet.

66. A method, according to claim 59, 60, or 63, wherein said free end has a free end edge faced to an ejection outlet side.

67. A head according to claim 33, 36, 40, or 43, 50, 51, wherein said free end has a free end edge faced to an ejection outlet side.

68. A method according to claim 52, 53 or 54, further comprising the step of moving the head relative to a recording material to record an image on the recording material.

* * * * *

UNITED STATES PATENT AND TRADEMARK OFFICE

CERTIFICATE OF CORRECTION

PATENT NO. : 6,305,789 B1
DATED : October 23, 2001
INVENTOR(S) : Yoshie Nakata et al.

It is certified that error appears in the above-identified patent and that said Letters Patent is hereby corrected as shown below:

Title page,
Item [56], FOREIGN PATENT DOCUMENTS,
"0 443 798 A2 * 2/1991 (EP) ..... 347/61" should be deleted.

Figure 17:
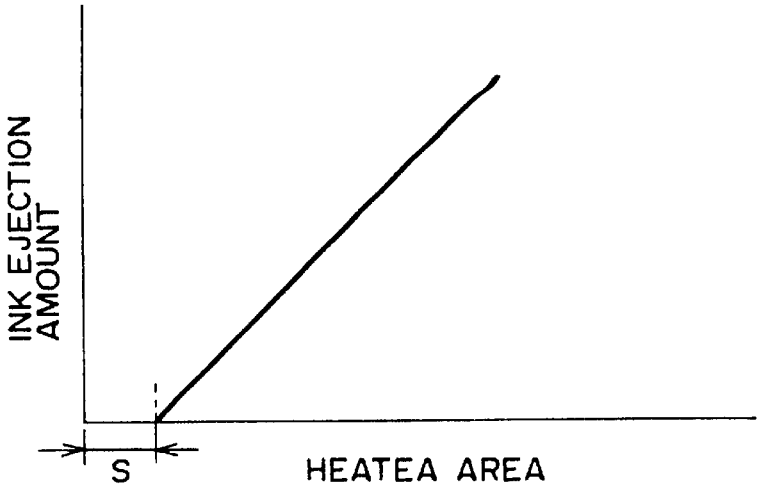
FIG. 17 is an illustration of a relation between the area of the heat generating element and the ink ejection amount.

Drawings,
Fig. 17, "HEATEA" should read -- HEATER --.

Column 1,
Line 26, "various processing device or" should read -- a processing device or various --.

Column 2,
Line 19, "th valve" should read -- the valve --;
Line 23, "occurs" should read -- occurring --;
Line 60, "the" should be deleted.

Column 3,
Line 11, "reduction" should read -- reduced --;
Line 37, "refuse" should read -- reuse --.

Column 6,
Line 58, "Providing" should read -- providing --;
Line 64, "Moving" should read -- moving --.

Column 7,
Line 5, "ejection" should read -- ejected --.

Column 8,
Line 15, "j" should be deleted;
Line 57, "blockdiagram" should read -- block diagram --.

Column 10,
Line 20, "the is" should read -- the bubble is --;
Line 41, "to to" should read -- to --.

Column 13,
Line 51, "b" should read -- by --.

UNITED STATES PATENT AND TRADEMARK OFFICE

CERTIFICATE OF CORRECTION

PATENT NO. : 6,305,789 B1
DATED : October 23, 2001
INVENTOR(S) : Yoshie Nakata et al.

It is certified that error appears in the above-identified patent and that said Letters Patent is hereby corrected as shown below:

Column 20,
Line 10, "of of" should read -- of --;
Line 52, "nyrtil" should read -- nitrile --;
Line 53, "stylene" should read -- styrene --.

Column 22,
Line 34, "the use is made with" should read -- use is made of --.

Column 23,
Line 27, "x$10^6$" should read -- 1 x $10^6$ --;
Line 66, "liquid" should read -- liquids --.

Column 24,
Line 52, "reduces" should read -- reduced --.

Column 25,
Line 5, "A s" should read -- As --;
Line 24, "grooved" should read -- grooved member 50 --.

Column 26,
Line 48, "gassification" should read -- gasification --;
Line 60, "includes:" should read -- include: --;
Line 61, "n- n-hexane," should read -- n-hexane --.

Column 27,
Line 22, "Thio diglycol" should read -- Thiodiglycol --;
Line 45, "Stylene-" should read -- Styrene --;
Line 51, "Glyceline" should read -- Glycerine --.

Column 28,
Lines 17, 24 and 54, "substratel" should read -- substrate 1 --;
Line 47, "example(A 189," should read -- example, (A189, --;
Line 48, "alcoholic" should read -- alcohol --;
Line 62, "from," should read -- from --.

UNITED STATES PATENT AND TRADEMARK OFFICE

CERTIFICATE OF CORRECTION

PATENT NO. : 6,305,789 B1
DATED : October 23, 2001
INVENTOR(S) : Yoshie Nakata et al.

It is certified that error appears in the above-identified patent and that said Letters Patent is hereby corrected as shown below:

Column 29,
Line 4, "residuals" should read -- residue --;
Line 6, "For" should read -- for --;
Line 8, "mJ/cm$_2$" should read -- mJ/cm$^2$ --;
Line 30, "board1" should read -- board 1 --;
Line 43, "massproduction" should read -- mass production --;
Line 44, "the use is made with" should read -- use is made of --.

Column 30,
Line 24, "the use" should read -- use was made of --;
Line 25, "was made with" should be deleted;
Line 61, "board1" should read -- board 1 --.

Column 31,
Line 9, "masspro-" should read -- mass pro --;
Line 42, "grooved" should read -- grooved member 50 --.

Column 33,
Line 59, "medium" should read -- mediums --.

Column 34,
Line 15, "the use is made with" should read -- use is made of --.

Column 35,
Line 46, 50, 54 and 58, "head" should read -- method --.

Column 37,
Line 25, "of" should read -- of a --;
Line 57, "by the" should be deleted.

Column 38,
Line 19, "of" should read -- of a --.

UNITED STATES PATENT AND TRADEMARK OFFICE

CERTIFICATE OF CORRECTION

PATENT NO. : 6,305,789 B1
DATED : October 23, 2001
INVENTOR(S) : Yoshie Nakata et al.

It is certified that error appears in the above-identified patent and that said Letters Patent is hereby corrected as shown below:

Column 39,
Line 8, "the" should read -- wherein the --;
Line 23, "having" should read -- having a --;
Line 59, "of" should read -- of the --.

Column 41,
Line 21, "claim 20," should read -- claim 25, --.

Column 42,
Line 26, "is" should read -- are --.

Signed and Sealed this

Thirtieth Day of April, 2002

*Attest:*

*Attesting Officer*

JAMES E. ROGAN
*Director of the United States Patent and Trademark Office*